US008016387B2

(12) United States Patent
Watanabe

(10) Patent No.: US 8,016,387 B2
(45) Date of Patent: Sep. 13, 2011

(54) INK JET HEAD

(75) Inventor: Hideo Watanabe, Tokyo (JP)

(73) Assignee: Konica Minolta IJ Technologies, Inc. (JP)

( * ) Notice: Subject to any disclaimer, the term of this patent is extended or adjusted under 35 U.S.C. 154(b) by 950 days.

(21) Appl. No.: 11/938,474

(22) Filed: Nov. 12, 2007

(65) Prior Publication Data

US 2008/0117263 A1 May 22, 2008

(30) Foreign Application Priority Data

Nov. 16, 2006 (JP) ..... 2006-310806

(51) Int. Cl.
*B41J 2/14* (2006.01)
*B41J 2/045* (2006.01)

(52) U.S. Cl. ..... 347/50; 347/69; 347/71

(58) Field of Classification Search ..... 347/50, 347/58, 68–72

See application file for complete search history.

(56) References Cited

U.S. PATENT DOCUMENTS 5,646,661 A * 7/1997 Asai et al. ..... 347/69

FOREIGN PATENT DOCUMENTS

JP 2004-90374 3/2004
JP 2006-82396 3/2006

* cited by examiner

*Primary Examiner* — Geoffrey Mruk
(74) *Attorney, Agent, or Firm* — Cantor Colburn LLP

(57) ABSTRACT

An ink jet head includes a head chip having driving walls made up of piezoelectric device, ink channels that eject ink, air channels that do not eject ink, driving electrodes formed inside of the of the channels, at least one common electrode that conducts with the driving electrodes of the air channels, and connection electrodes that conduct with the driving electrodes of the ink channels separately, wherein the ink channels and the air channels are alternatingly arranged in parallel and form channel rows arranged in parallels, and a nozzle plate joined to a front surface of the head chip and has a plurality of nozzles, wherein individual connection electrodes of any adjacent two channel rows formed at a side of an edge of the head chip are lead out and aligned at the edge of the head chip.

24 Claims, 14 Drawing Sheets

INK JET HEAD

RELATED APPLICATION

This application is based on Japanese Patent Application No. 2006-310806 filed on Nov. 16, 2006 in Japanese Patent Office, the entire content of which is hereby incorporated by reference.

FIELD OF THE INVENTION

The present invention relates to ink jet heads, and in particular to ink jet heads in which it is possible to easily make electrical contacts between driving electrodes and driving circuits of a head chip having a plurality of channel rows in which are provided alternately ink channels that eject ink and air channels that do not eject ink.

DESCRIPTION OF THE RELATED ART

Conventionally, as a shear mode type ink jet head that causes shear deformation of driving walls by applying a voltage to the electrodes formed in the driving walls that separate the channels and causing the ink in the channel to be ejected out from the nozzle using the force thereby generated, it has been known to use one having the so-called harmonica type head chip in which openings of the respective channels are provided on the front and rear surfaces.

In a harmonica type head chip of this kind, a problem to be solved is how to make electrical connection between the different driving electrodes and the driving circuits.

For example, conventionally, an ink jet head has been proposed in which, penetrating electrodes are provided in a cover substrate of the head chip that closes the top of the channels, the driving electrode in each channel is lead out to the surface of the cover substrate of the head chip, and the electrical connections between the different driving electrodes and the driving circuits are made on the surface of this cover substrate by FPC, etc. (Japanese Unexamined Patent Publication No. 2004-90374)

However, providing penetrating electrodes in the cover substrates requires difficult operations such as the operation of making penetrating holes, and the operation of embedding conductive material in the penetrating holes. Because of this, even an ink jet head has been proposed in which, leading electrodes that conduct to the each driving electrode are formed by leading out on the rear surface of the head chip which is the surface opposite to the surface from which the ink is ejected out, a wiring substrate is joined to this rear surface of the head chip, and the edge part of the wiring substrate is joined to FPC thereby making electrical connection between the different driving electrodes and the driving circuits. (Japanese Unexamined Patent Publication No. 2006-82396)

Since the leading out and formation of connection electrodes on the rear surface of the head chip in this manner can be made using a common metal thin film patterning method, it is possible to easily lead out and form the leading electrodes with a high accuracy compared to providing penetrating electrodes in the cover substrate.

However, since, in a shear mode type ink jet head, two adjacent channels commonly use a single driving wall between the two channels, a shear mode type ink jet head of independent channel type is known in which the alternating and adjacent channels are separated into an ink channel that ejects ink and an air channel that does not eject ink.

In the case of the ink jet head of independent channel type, although voltage is applied individually to the driving electrodes of different ink channels, since all the driving electrodes of the air channels are grounded together or connected to a single common electrode, it is possible to ground all the driving electrodes of the air channels using a single common electrode. Therefore, by forming different connection electrodes and a single common grounding electrode with a row of alternate ink channels and air channels provided in between these electrodes, and by leading out different connection electrodes and a single common grounding electrode at both ends of the rear surface of the head chip, it is possible to align only the connection electrodes at one edge part of the rear surface of the head chip, and to obtain electrical connection easily to FPC, etc.

However, in the case of a head chip in which higher densities are aimed at by providing in parallel two or more rows of channels in which ink channels and air channels are provided alternatingly, because the rows of channels are adjacent to each other, it may not be possible to lead out the connection electrodes up to the edge part of the head chip. For example, in the case of a head chip having two rows of channels, row A and row B, it is difficult to lead out the connection electrodes from the ink channels of row B to the edge part of the head chip on the side that has exceeded row A. This is because it is necessary to exceed the channels of row A.

In this case, although it is possible to consider leading out the connection electrodes between the ink channels and the air channels of row A, since this gap is extremely small, it is extremely difficult to form by leading out the connection electrodes without the danger of electrical short circuits or open circuits.

Therefore, even in a harmonica type head chip of the independent channel type in which a plurality of rows of channels are provided, it is desired to simplify the electrical connections to FPC, etc. by grouping together and providing the connection electrodes from the ink channels at the edge part of the rear surface of the head chip.

SUMMARY OF THE INVENTION

The purpose of the present invention is to provide an ink jet head in which electrical connections to an FPC etc. are simplified by aligning the different connection electrodes formed by leading out from each ink channel to the edge part of the rear surface of an independent channel type harmonica type head chip in which a plurality of rows of channels have been provided.

In order to solve the above problem, the present invention provides an ink jet head having a head chip, the head chip comprising;

a plurality of driving walls made up of piezoelectric device arranged in parallel with a predetermined distance;

a plurality of ink channels that eject ink, sandwiched by the driving walls, having opening parts of the channels on a front surface and on a rear surface of the head chip;

a plurality of air channels that do not eject ink, sandwiched by the driving walls, having opening parts of the channels on a front surface and on a rear surface of the head chip;

a plurality of driving electrodes formed inside of the plurality of ink channels and the plurality of air channels, that causes shear deformation of the driving walls by applying a voltage;

at least one common electrode that conducts with the driving electrodes of the air channels; and a plurality of connection electrodes that conduct with the driving electrodes of the ink channels separately, wherein the ink channels and the air channels are alternatingly arranged in parallels and form a plurality of channel rows arranged in parallels; and the ink head further having a nozzle plate joined to a front surface of the head chip that closes the opening parts of the air channels on the front surface and has a plurality of nozzles at the opening parts of the ink channels on the front surface, wherein individual connection electrodes of any adjacent two channel rows formed at a side of an edge of the head chip among the plurality of channel rows are aligned at the edge of the head chip.

DESCRIPTION OF THE PREFERRED EMBODIMENT

Figure 1:
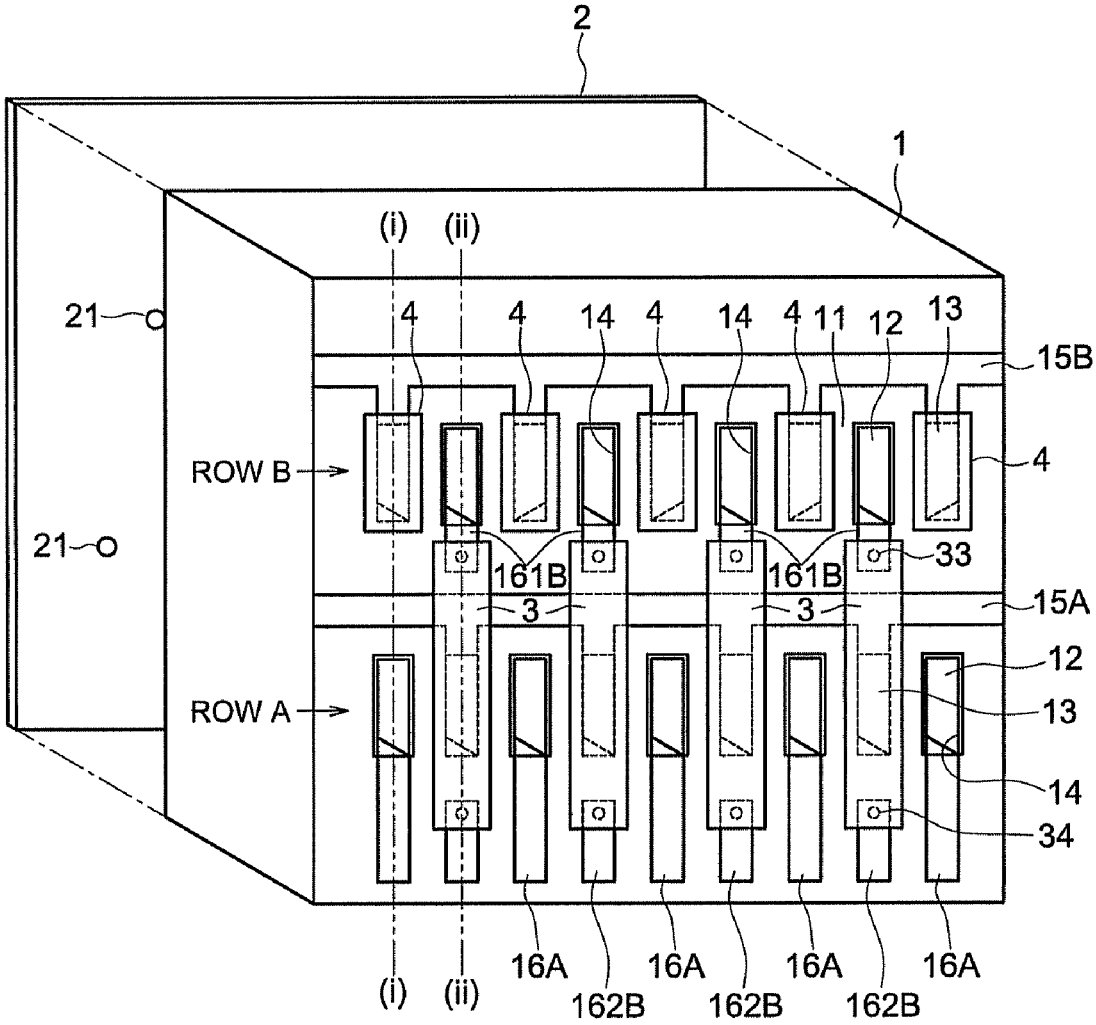
FIG. 1 is a perspective view of the head chip part of the ink jet head according to the present invention as viewed from the rear surface side.

In the following, a preferred embodiment of the present invention is described referring to the drawings.

Figure 2:
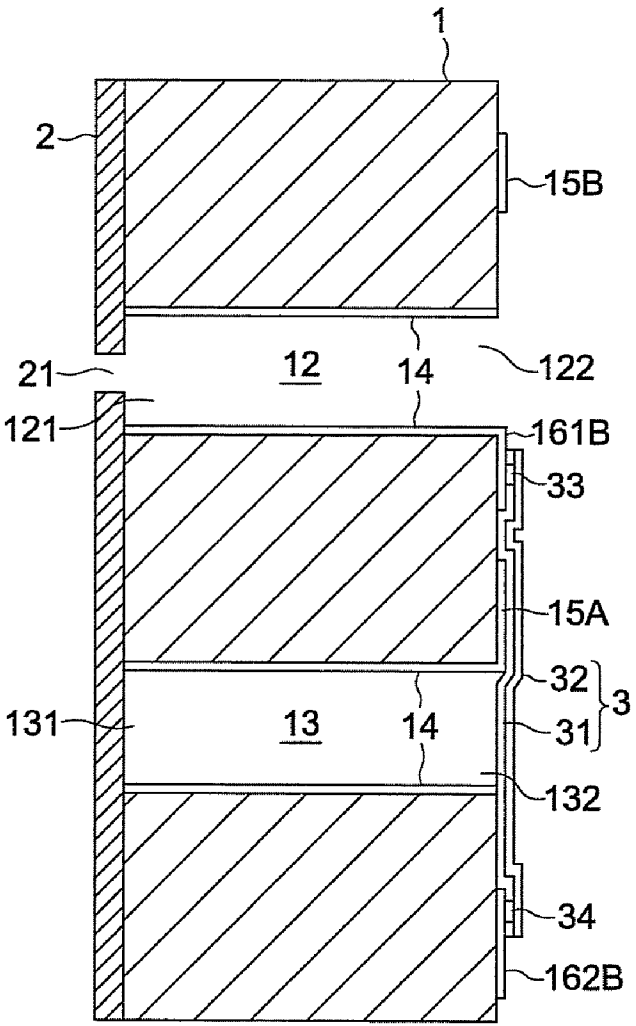
FIG. 2(*a*) is a cross-sectional view along the line (i)-(i) in FIG. 1, and FIG. 2(*b*) is a cross-sectional view along the line (ii)-(ii) in FIG. 1.
Figure 2:
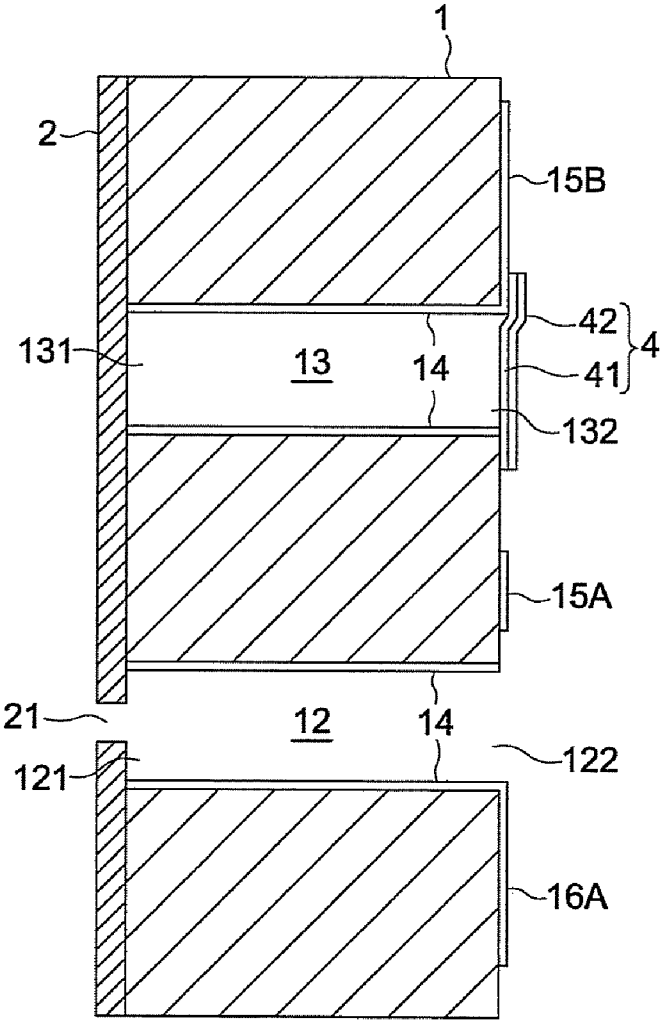

FIG. 1 is a perspective view of the head chip part of the ink jet head according to the present invention as viewed from the rear surface side, FIG. 2(*a*) is a cross-sectional view along the line (i)-(i) in FIG. 1, and FIG. 2(*b*) is a cross-sectional view along the line (ii)-(ii) in FIG. 1.

In these figures, 1 is the head chip, 2 is the nozzle plate joined to the front surface of the head chip 1.

Further, in the present patent specification, in the following, the surface on the side in which ink is ejected from the head chip is called the "front surface", and the surface opposite to it is called the "rear surface". In addition, the outer surfaces at the top and bottom in the figure that straddle the channels provided in the head chip are referred to respectively as the "top surface" and the "bottom surface".

In the head chip 1, two rows are provided which align the driving walls 11 made of a piezoelectric device and the channels 12 and 13 alternatingly. Here, although each row of channels is shown to have nine channels of channels 12 or channel 13 as an example, there is no particular restriction on the number of channels in a row of channels.

Here, the row of channels present on the bottom side in the figure is referred to as row A, and the row of channels present on the bottom side in the figure is referred to as row B.

This head chip 1 is an independent channel type head chip in which each row of channels is constituted so that the ink channels 12 that eject ink and the air channels 13 that do not eject ink are alternatingly aligned in line. The shapes of each of the channels 12 and 13 are such that the two side walls are extending almost perpendicular to the top surface and the bottom surface of the head chip 1, and are parallel to each other.

Opposite the front surface and the rear surface of the head chip 1 are present the opening parts 121 and 131 of the front side and the opening parts 122 and 132 of the rear side of each of the respective channels 12 and 13. Each of the channels 12 and 13 is of the straight type that has almost the same shape and size in the longitudinal direction from the opening parts 122 and 132 of the rear side to the opening parts 121 and 131 of the front side.

Further, the row A and the row B are formed so that the ink channels 12 and the air channels 13 are formed with a shift of one pitch. In other words, as is shown in FIG. 1 and FIG. 2, when the head chip is viewed in the top and bottom direction in the figure, the ink channels 12 of row A and the air channels 13 of row B are positioned along the same line, and the air channels 13 of row A and the ink channels of row B are positioned along the same line.

On the entire inner surface of each of the channels 12 and 13 and in close contact with it are formed the driving electrodes 14 which are films of metals such as Ni, Au, Cu, Al, etc.

Further, on the rear surface of the head chip 1, a single common electrode 15A that electrically connects with all the driving electrodes 14 inside the air channels 13 of row A is formed by leading towards the row B side in the top part of the figure, and a single common electrode 15B that electrically connects with all the driving electrodes 14 inside the air channels 13 of row B and also extends along the direction of the rows of channels between row A and row B (in the left-right direction in the figure) is formed so as to be lead out towards the top edge part of the rear surface of the head chip 1 which is the same direction as the direction of leading out the common electrode 15A of row A, and extends in the channel row direction in that top edge part (the left-right direction in the figure).

Further, each of the common electrodes 15A and 15B of row A and row B are not formed individually for each row of channels as is shown in FIG. 1, but can also be a single electrode common to row A and row B, though not shown in the figure. In this case, the common electrode for row A is formed by leading out towards the side of row B, and also, the common electrode for row B is formed by leading out towards the side of row A, combining the two ends of leading out the two common electrodes together into one, and to form a single common electrode along the channel row direction (the left-right direction in the figure) in between row A and row B.

In addition, on the rear surface of the head chip 1, the connection electrodes 16A that are in electrical contact with the driving electrodes 14 inside the ink channels of row A are formed by leading out individually in the downward direction in the figure, towards the bottom edge part of the rear surface of the head chip 1 which is a direction opposite to the row B side which is the direction of leading out the common electrode 15A, and are in parallel to each other at that bottom edge part.

On the other hand, in each of the channels 12 of row B, a first connection electrode 161B that is in electrical contact with the driving electrodes 14 inside the channels 12 is formed by leading out individually towards the row A side in the downward direction in the figure which is a direction opposite to the direction of leading out the common electrode 15B, and are in parallel to each other and extend up to just before the common electrode 15A of that row A.

Further, at the bottom part side on the rear surface of the head chip 1 lower of the air channels 13 of row A, a second set of connection electrodes 162B corresponding to each ink channel of row B are formed individually and are aligned with the connection electrodes 16A of row A so that they are positioned in between the individual connection electrodes 16A of row A. These first connection electrodes 161B and the second connection electrodes 162B are the connection electrodes formed to be lead out to the rear surface of the head chip 1 in order to apply voltages to the driving electrodes 14 inside each of the ink channels 12 of row B. In other words, at the rear surface of the head chip 1, the connection electrodes that are in electrical contact with the different driving electrodes 14 inside the different ink channels of row B are separated into these first connection electrodes 161B and the second connection electrodes 162B.

Therefore, it is necessary to connect electrically the first connection electrodes 161B with the second connection electrodes 162B corresponding to these first connection electrodes 161B. In order to do this, the connection wirings 3 are formed from the first connection electrodes 161B to the second connection electrodes 162B while crossing over the common electrode 15A of row A and row A.

The connection wirings 3 are formed as strips that are slightly wider than the ink channels 12 and the air channels 13, and have a length that is sufficient so that they start from the first connection electrodes 161B, cross over the common electrode 15A or row A and the air channels 13 of row A, and reach the corresponding second connection electrodes 162B.

These connection wirings 3 are provided individually corresponding to each ink channel 12 of row B, and, as is shown in FIG. 2(*b*), are respectively configured as a multilayer structure having an insulating layer 31 and a metal film layer 32, respectively, and among these, the insulating layers 31 are formed from the first connection electrode 161B to the second connection electrode 162B passing over the common electrode 15A and the air channels 13 of row A and are adhered to the rear surface of the head chip 1 so that the insulating layers 31 are positioned on the rear surface side of the head chip 1. At this time, the connection wirings 3 are adhered so that they completely close the opening part 132 on the rear surface side of the different air channels 13 of row A, and the flow path is thereby restricted so as to prevent the flow of ink to the different air channels 13 or row A. As a consequence, because of the connection wirings 3 can also function as a flow restricting member that restricts the flow of ink to the different air channels 13 of row A, it is a desirable form to adhere the connection wirings 3 in this manner so as to completely close the opening part 132 of the different air channels 13 of row A.

Penetrating electrodes 33 and 34 that penetrate through the respective insulating layers 31 are provided in the connection wirings 3 in the region in which the first connection electrodes 161B overlap the metal film layer 32 of the connection wiring 3 and in the region in which the second connection electrodes 162B overlap the metal film layer 32 of the connection wiring 3. Therefore, the metal film layer 32 of the connection wirings 3 conducts respectively with the first connection electrodes 161B and the second connection electrodes 162B because of these penetrating electrodes 33 and 34, and hence the first connection electrodes 161B and the second connection electrodes 162B are electrically connected with each other. In order to improve the reliability of conduction, it is also possible to form a plurality of each of the penetrating electrodes 33 and 34.

As a result of this, the driving electrodes 14 inside the different ink channels 12 of row B are electrically connected to the second connection electrodes 162B via the first connection electrodes 161B, the penetrating electrode 33 or the connection wirings 3, the metal film layer 32, and the penetrating electrode 34, and are lead out to the bottom edge part of the rear surface of the head chip 1 in parallel with the connection electrodes 16A of the different ink channels 12 of row A by those second connection electrodes 162B.

Further, even the opening parts 132 on the rear surface side of the different air channels 13 of row B, similar to the air channels 13 of row A, are individually provided with a flow path restricting member 4 for preventing the flow of ink, thereby completely closing the opening parts 132 of each of the air channels 13. Although this flow path restricting member 4 is not mandatory in the present invention, it can be provided desirably.

Even the flow path restricting member 4, similar to the connection wirings 3, is configured to have a multilayer structure having an insulating layer 41 and a metal film layer 42, and it is desirable to have a construction in which the insulating layer among these is adhered so that it is placed on the rear surface of the head chip 1. By having this type of construction, as is explained later, it is possible to provide the flow path restricting member 4 on the rear surface of the head chip 1 at the same time as the connection wirings 3.

A nozzle plate 2 is joined to the front surface of the head chip 1. The nozzle plate 2 has nozzles 21 provided only at positions corresponding to the different ink channels of row A and row B. Therefore, the front surface side of the opening part 131 of the different air channels 13 that do not eject ink are closed by the nozzle plate 2.

Next, although examples of manufacturing the head chip 1 in such an ink jet head is explained referring to FIG. 3 to FIG. 8, the present invention shall in no manner be limited to these.

Figure 3:
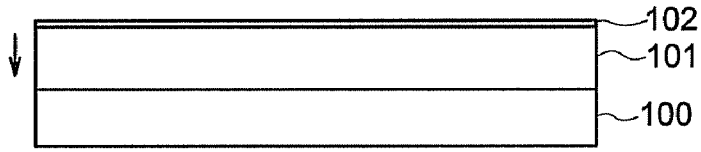
FIG. 3(*a*) to FIG. 3(*e*) are drawings for explaining a sample structure of the head chip.
Figure 3:
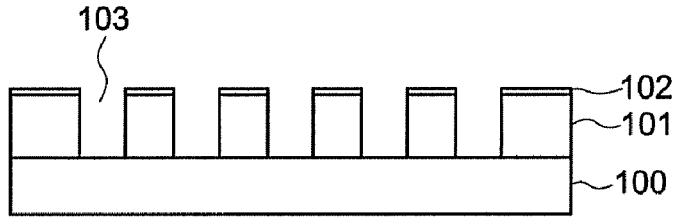
Figure 3:
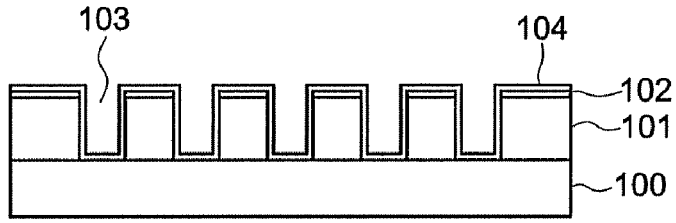
Figure 3:
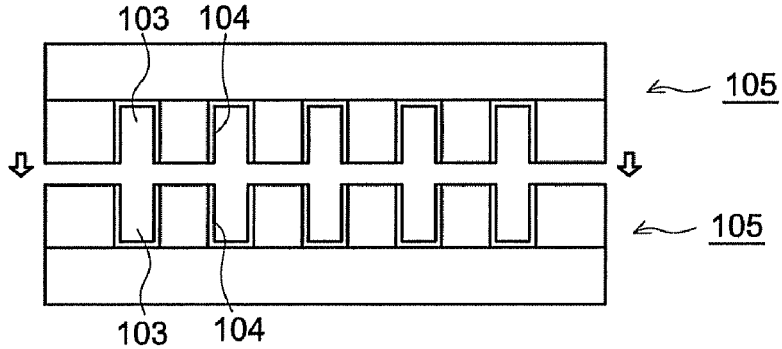
Figure 3:
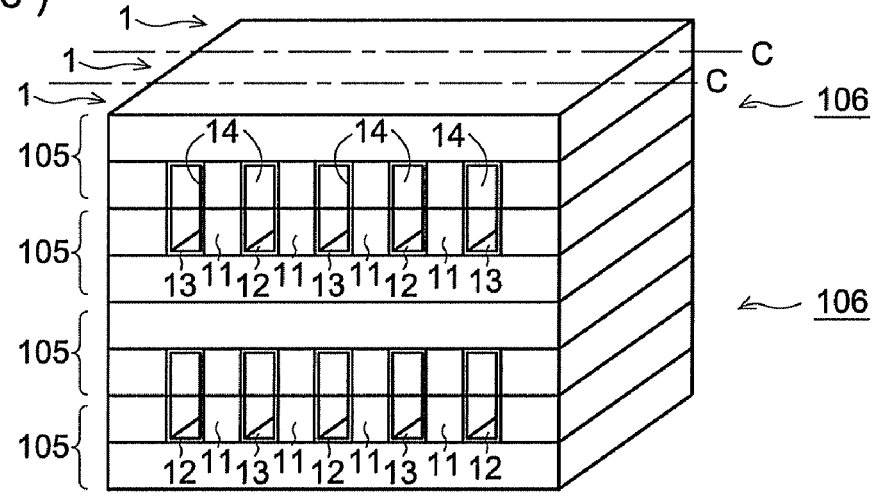

To begin with, a piezoelectric device substrate 101 made of polarized PZT is bonded on a substrate 100, and in addition, a dry film 102 is adhered onto the surface of that piezoelectric device substrate (FIG. 3(*a*)).

Next, a plurality of parallel grooves 103 are cut by using a dicing blade or other techniques from the side of that dry film 102. By cutting the grooves with a constant depth that almost reaches the substrate 100 and also so that each groove 103 extends from one end of the piezoelectric device substrate 101 to the other end, a straight shape is formed that almost does not change in size or shape in the longitudinal direction (FIG. 3(*b*)).

Next, a metal film 104 is formed on the top surface of the dry film 102 that is remaining after cutting the groove and on the inner surface of each of the grooves 103 by the sputtering method or the evaporation method using a metal for forming electrodes such as Ni, Au, Cu, and Al, etc., from the cut side of the grooves 103 (FIG. 3(*c*)).

Thereafter, by removing the dry film 102 along with the metal film 104 formed on its surface, a substrate 105 is obtained with the metal film 104 formed only on the inner surface of the different grooves 103. Next, two substrates 105 formed in the same manner are taken, and the two substrates are positioned so that the grooves 103 in the two substrates 105 match with each other, and the two substrates are joined together using an epoxy type adhesive (FIG. 3(*d*)).

Next, two head substrates 106 obtained in this manner are placed one over the other and are bonded, and by cutting this in a direction perpendicular to the longitudinal direction of the grooves 103, several pieces of harmonica type head chips 1 having two rows of channels are prepared simultaneously. Each groove 103 becomes a channel 12 or 13, and the metal film 104 in each groove 103 becomes the driving electrode 14, and the driving wall 11 is formed between adjacent grooves 103. The width between the cutting lines C,C, - - - , determines the drive length (length L) of the ink channel 12 of the head chips 1, 1, - - - , and is determined appropriately according to this drive length (FIG. 3(*e*)).

Figure 4:
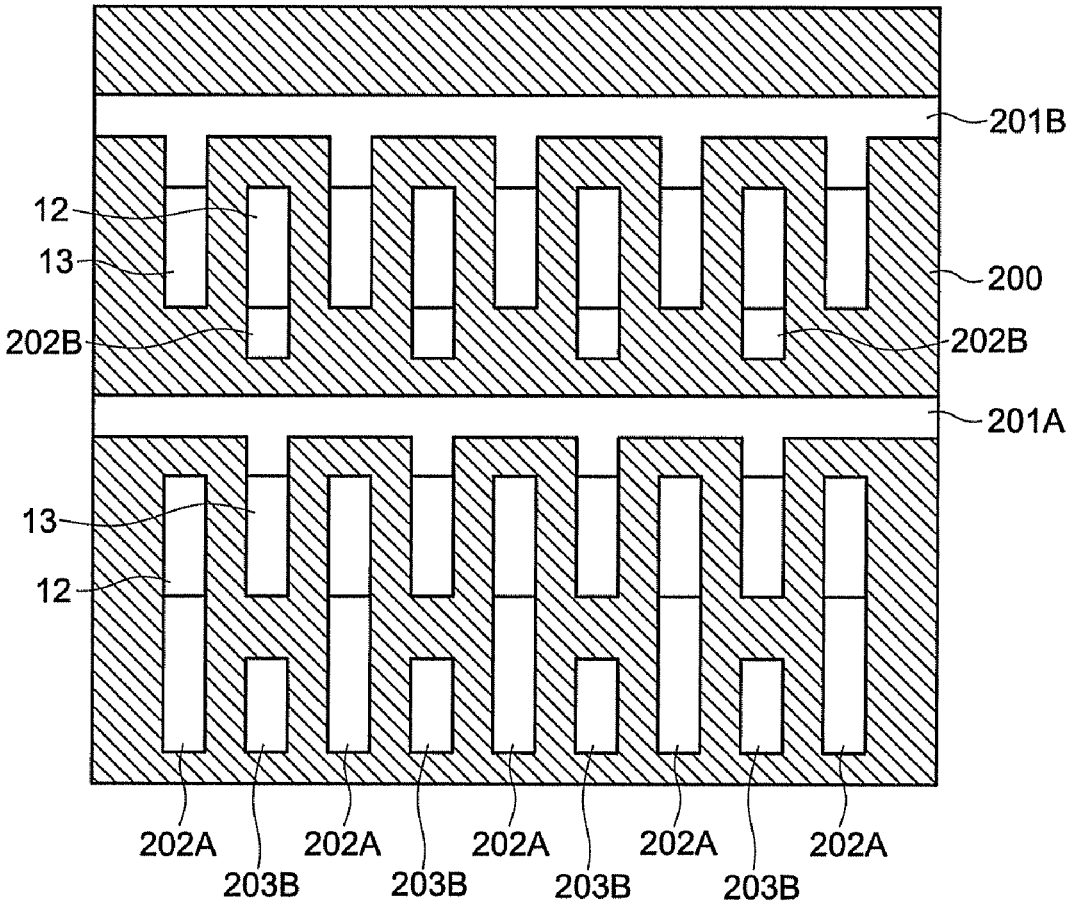
FIG. 4 is a drawing for explaining a sample structure of the head chip.1

Next, a dry film 200 is adhered to the rear surface of the head chip obtained in this manner, and the opening parts 201A and 201B for forming the common electrodes 15A and 15B, the opening part 202A for forming the connection electrode 16A, the opening part 202B for forming the first connection electrode 161B, and the opening part 203B for forming the second connection electrode 162B are formed by exposure and development (FIG. 4).

Next, from the side of this dry film 200, a metal such as Al for forming the electrodes is applied by vacuum deposition thereby forming selectively an Al film inside each of the opening parts 201A, 201B, 202A, 202B, and 203B. Using this Al film, the respective common electrodes 15A and 15B, the connection electrode 16A, the first connection electrode 161B, and the second connection electrode 162B are formed on the rear surface of the head chip 1.

In order to make the connection secure with the driving electrodes 14 inside each of the ink channels 12 and with the driving electrodes 14 inside each of the air channels 13, it is desirable that the evaporation is made twice after changing the direction. In concrete terms, it is desirable to carry out from directions of 30 degrees each in the up and down directions from a direction that is perpendicular to the surface shown in the figure. In addition, as is shown in FIG. 3(*d*), in order to make secure the connection between the metal films 104 that are separated into top and bottom parts, it is desirable to carry out evaporation from an angle of 30 degrees to the left or right.

Figure 5:
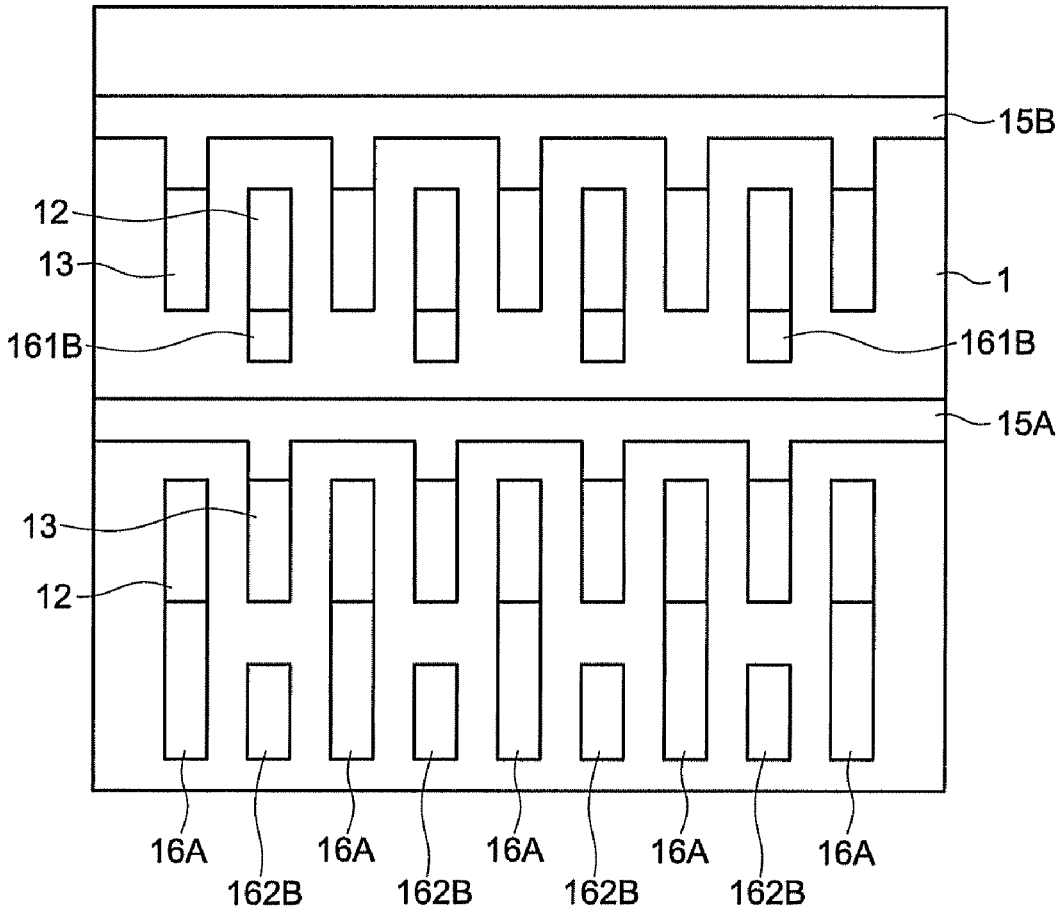
FIG. 5 is a drawing for explaining a sample structure of the head chip.

Further, the method of forming Al films is not limited to evaporation, and it is possible to use any common thin film formation method. In addition, it is also possible to coat conductive paste by the ink jet method. In particular, since the direction of metal particles flying in the sputtering method is random, it is desirable to use this method because it is possible to form the metal film up to the interior of the channel even if the direction is not changed. After forming the Al film, by dissolving and peeling off the dry film 200 using a solvent, the Al film formed on the dry film is removed, and only the common electrodes 15A and 15B, the connection electrode 16A, the first connection electrode 161B, and the second connection electrode 162B remain on the rear surface of the head chip 1 (FIG. 5).

Further, considering the ease of operation of the development process and water washing process of the dry film 200, it is desirable that the dry film 200 has openings at the entire area of all the channels 12 and 13. By opening over the entire area, it becomes easy to remove the developer liquid and cleaning water inside the channels 12 and 13.

Figure 6:
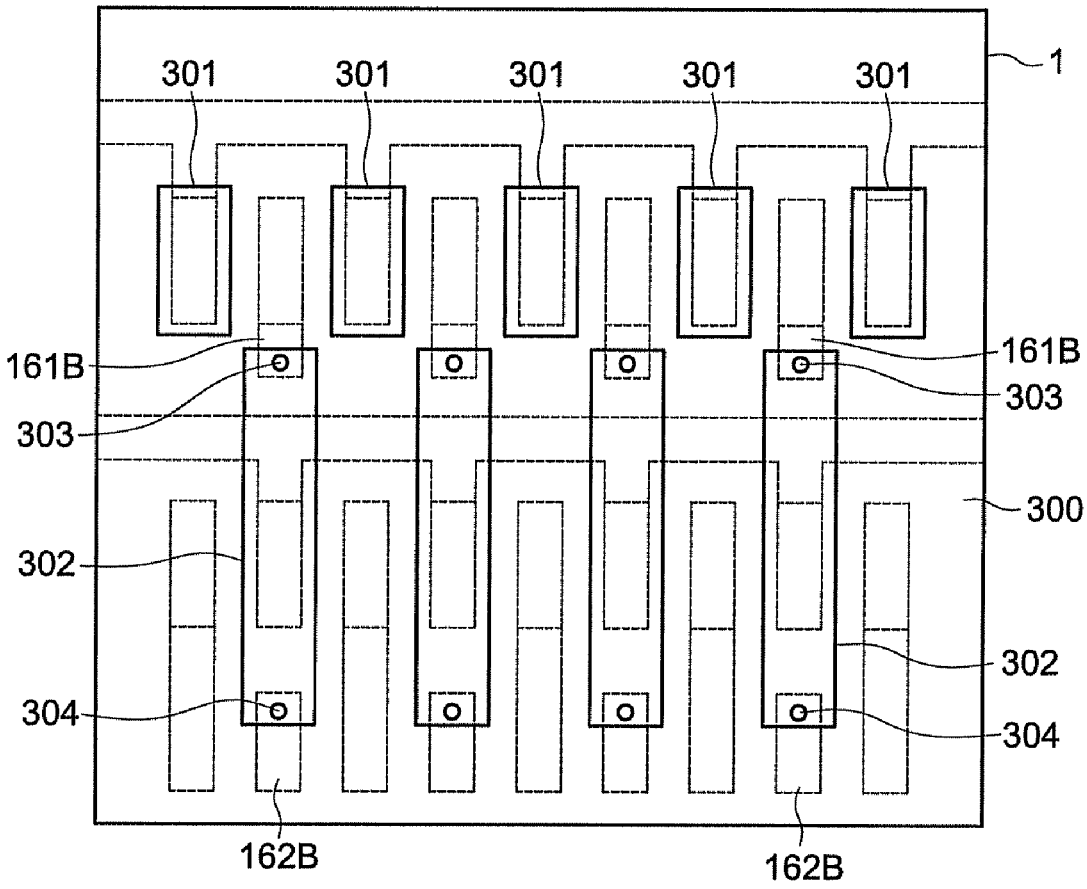
FIG. 6 is a drawing for explaining a sample structure of the head chip.

Next, an insulating film 300 in which are formed a metal film 301 having a size that can completely close each of the air channels of row B, a metal film 302 having a length that extends to each of the first connection electrodes 161B of row B and the second connection electrodes 162B,and the penetrating electrodes 303 at the region where the metal film 302 overlaps the first connection electrodes 161B and the penetrating electrodes 304 at the region where this metal film 302 overlaps the second connection electrodes 162B, is adhered using an epoxy based adhesive so that the side of that insulating film 300 contacts the rear surface of the head chip 1 (FIG. 6).

Here, as the insulating film 300, it is desirable to use an organic film that can be patterned by a common dry etching method, and for example, it is possible to use films of various types of plastics such as polyimide, liquid crystal polymer, aramid, polyethylene terephthalate, etc. Among these, polyimide film which has good etching characteristics is desirable. Also, in order to simplify dry etching, although it is desirable to use as thin a film as possible, it is desirable to use an aramid film which has a high strength and can maintain the strength even when it is thin.

Further, as an insulating layer that can be dry-etched, it is also possible to use a silicon substrate. However, special gases such as CF4 or SF6 need to be used for the dry etching of silicon, in general the cost increases because even the equipment becomes special.

It is desirable that the thickness of the insulating film 300 is 10 to 100 μm from the point of view of maintaining strength and ease of dry etching.

The metal film 302 formed on one surface of this insulating film 300 not only functions as a metal film layer 32 of the connection wiring 3 for electrically connecting the first connection electrode 161B and the second connection electrode 162B, but also at the same time functions as a masking material along with the metal film 301 during the dry etching process which is a subsequent process. The metals that can be used for the metal films 301 and 302 are Al, Cu, Ni, W, Ti, Au, etc., and among these, Al is desirable because it is low in cost and also its patterning can be done easily, and it is possible to form the Al film by sputtering, and to form it by a common think film patterning technology.

The thicknesses of these metal films 301 and 302 should desirably be 0.1 to 50 μm from the point of view of ability to withstand dry etching and the ease of patterning.

Here, as the insulating film 300, a 25 μm polyimide film in which the penetrating electrodes 303 and 304 were formed beforehand is used with an Al film of 5 μm formed on it.

The penetrating electrodes 303 and 304 can be formed by the method of forming penetrating holes in advance in the insulating film 300 by laser drilling, and carrying out through hole plating. A photoresist is coated on this film, patterning of the photoresist is done by a normal photolithography process, Al is etched by phosphoric acid, and the metal films 301 and 302 of Al are formed by independent patterning on the insulating film 300 as is shown in FIG. 6.

The insulating film 300 with metal films 301 and 302, and the penetrating electrodes 303 and 304 was positioned and adhered to the rear surface of the head chip 1 using an epoxy type adhesive (Epotec 353ND manufactured by Epoxy Technologies Ltd.). The hardening condition was a temperature of 100° C., 30 minutes, and pressure of 10 kg/cm$^2$.

Figure 7:
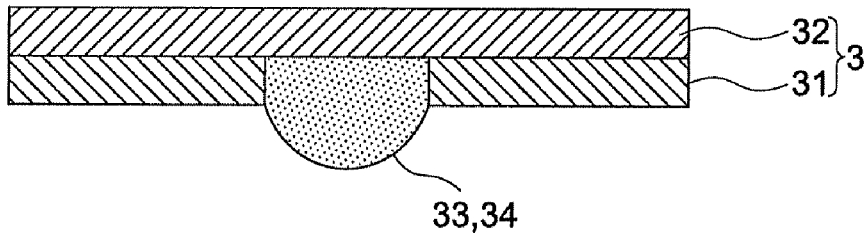
FIG. 7 is an enlarged cross-sectional view showing a part of a penetrating electrode forming a bump relating to another form of the connection.

Further, apart from this, it is also possible to use an FPC substrate made of a polyimide film on which a copper film is formed. In the case of FPC substrate, the penetrating electrodes can be formed by forming penetrating holes reaching the copper film through the polyimide from the opposite side of the copper film with laser drilling, and growing copper in the penetrating holes with plating method. The penetrating electrodes is desired to form, so called, bumps protruding and growing from the polyimide film in order to make a connection secure in case of realizing the electric connection through the pressure bonding disclosed below. The surface of the bumps is desired to be coated with gold to inhibit oxidation. FIG. 7 shows an enlarged cross-sectional view showing a part of penetrating electrodes 33, 34 at the connection wirings 3 formed by the method disclosed above.

At the time of bonding the insulating film 300, the conduction between the penetrating electrodes 303 and 304 and the first connection electrode 161B and the second connection electrode 162B is done by the NCP method (Non Conductive Paste method) of pressing together and bonding the metal films using an adhesive. In this case, the epoxy type adhesive functions not only as an adhesive for the insulating film 300, but also as an NCP. In the case of the NCP method, since the connection can sometimes be difficult if the surface of the metal film is oxidized, it is desirable that the surfaces of the first connection electrode 161B and the second connection electrode 162B are metals such as Au, Pt, etc., and the surfaces of electrodes being metal such as Au, Pt, etc. can be realized by making the metal film have a plurality of layers.

Further, it is also possible to use the ACP method (Anisotropic Conductive Paste method) of using an adhesive in which metal particles have been dispersed. In this case, since the metal particles make the connection by penetrating the oxide film on the surface of the metal film, even in the case of surfaces of an easily-oxidizable metal such as Al of the first connection electrode 161B and the second connection electrode 162B, it is possible to obtain a secure electrical connection.

In the present preferred embodiment, by manufacturing while taking care about the oxidization of Al, it was possible to have electrical connection using the NCP method even without having to form Au on the surface of Al, and without having to use the ACP method.

Further, apart from the method of adhering an insulating film 300 on the rear surface of the head chip 1 after patterning the different metal films 301 and 302 in this manner, it is also possible to carry out the patterning of the metal films 301 and 302 by etching after adhering on the rear surface of the head chip 1 an insulation film such as a polyimide film with a metal film of Al, etc., formed over its entire surface before patterning. Even in this case, the penetrating electrodes 303 and 304 are formed beforehand.

In this case, although the pattern is transferred using a photo mask, the positioning of the photo mask with respect to the head chip 1 can be made to an accuracy of a few micrometers using an exposure equipment, and an accuracy that cannot be obtained using other processes can be obtained. In addition, according to this method, because of the presence of a metal film formed over the entire surface, even if an extension occurs in the insulating film 300 due to heating and pressure during adhering the insulating film 300, since the metal films 301 and 302 are patterned at the prescribed positions thereafter, there is the advantage that there is no fear of a shift occurring in the positions of the different air channels 13, the first connection electrode 161B, and the second connection electrode 162B.

Next, dry etching is made of the rear surface of this head chip 1, and the unnecessary insulating film 300 is removed. A concrete means of dry etching can be selected appropriately to suit the type of plastic used for the insulating film 300. For example, when a polyimide film is used as in the present preferred embodiment, it is possible to carry out dry etching using oxygen plasma. Here, a parallel plate type RF plasma apparatus is used as the oxygen plasma equipment, oxygen gas of 50 sccm is introduced after creating a vacuum, and the pressure was made 10 Pa by adjusting the valve. An RF with a frequency of 13.56 MHz and a power of 500 W was turned on, and the polyimide was dissociated and removed by the generated oxygen plasma. The polyimide can be removed in about 10 minutes. At this time, since the surface metal films 301 and 302 do not get dissociated by the oxigen plasma, these metal films 301 and 302 act as a mask, and the insulating film 300 below them remains as it is without being etched away.

Although it is also possible to use wet etching for this etching, since, in general, the etching liquid is acidic or alkaline, and is likely to dissolve the driving electrodes 14, dry etching is desirable. Furthermore, in case even if the adhesive seeps out at the time of adhering the insulating film 300, since even the unnecessary adhesive is removed by dissociation at the same time during dry etching, the problem of excessive adhesive blocking the channels or covering the surface of the electrodes is prevented.

Further, since the insulating film at the parts that are not masked by the metal films 301 and 302 are completely removed, it is possible to make the external dimensions of the insulating film 300 larger than the rear surface of the head chip 1 at the state of adhering to the rear surface of the head chip 1, and there is the advantage that the easy of operation is far superior.

In addition, the dry etching method need not be restricted to the above method but can be selected appropriately.

Figure 8:
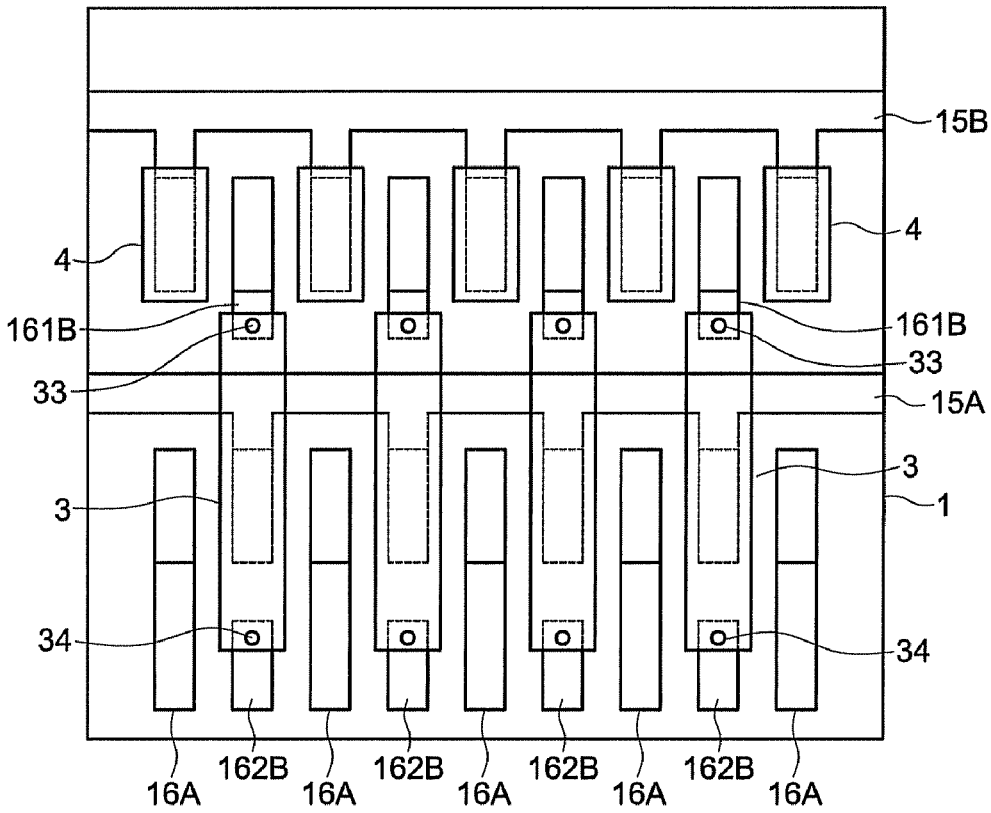
FIG. 8 is a drawing for explaining a sample structure of the head chip.

On the rear surface of the head chip 1, because of the insulating film 300, metal films 302, penetrating electrodes 303 and 304 that have remained after dry etching, the connection wirings 3 having an insulating layer 31, metal film layer 32, and penetrating electrodes 33 and 34 are formed individually, and electrically connect the first connection electrode 161B and the second connection electrode 162B. Further, even in the air channels of row B, at the same time, due to the insulating film 300 and the metal film 301, rectangular shaped flow path restricting members 4 made up of an insulating layer 41 and a metal film layer 42 are formed individually and independently, and completely close the opening part 132 (FIG. 8).

The driving electrodes 14 have not been shown in FIG. 4 to FIG. 8.

In this manner, according to the present invention, since the connection electrodes 16A and the first connection electrode 161B and the second connection electrode 162B via the connection wirings 3 that are lead out and formed from the driving electrodes 14 inside the ink channels 12 of a plurality of channel rows (row A, row B), are wired in a single row at the edge part of the rear surface of the head chip 1, the electrical connection between the driving electrodes 14 inside each of the ink channels 12 of each row of channels and the driving circuits can be made only at the edge part of the rear surface of the head chip 1 using FPC, etc.

In addition, the connection wirings 3 not only carry out electrical connection between the first connection electrode 161B and the second connection electrode 162B, but at the same time also carry out the function as a flow path restricting member by completely closing the opening parts 132 of the different air channels 13 of row A, by similarly closing completely the opening parts 132 of the different air channels 13 of row B using the flow path restricting member 4, it is possible to obtain easily a structure in which the flow of ink to all the air channels 13 is prevented.

In the above preferred embodiment, although the conduction between the first connection electrodes 161B and the metal film layer 32 of the connection wirings 3 and the conduction between the second connection electrodes 162B and the metal film 32 of the connection wirings 3 were achieved by the penetrating electrodes 33 and 34, it is not necessary to restrict to this, and it is possible to adopt various other methods as long as the conduction between the two is achieved.

Figure 9:
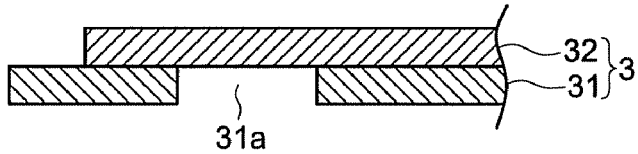
FIG. 9(*a*) is a cross-sectional view showing the connection in which a removed part is formed, and FIG. 9(*b*) is its plan view.
Figure 9:
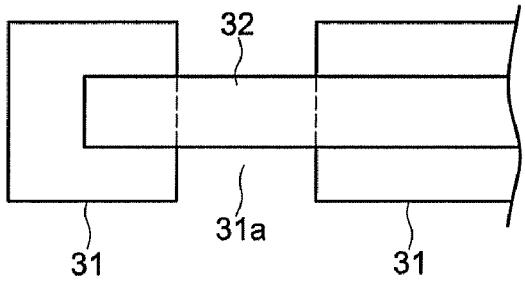
Figure 10:
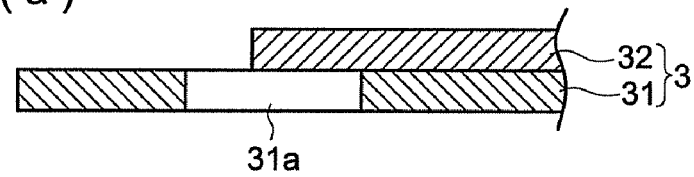
FIG. 10(*a*) is a cross-sectional view showing another form of the connection in which a removed part is formed, and FIG. 10(*b*) is its plan view.
Figure 10:
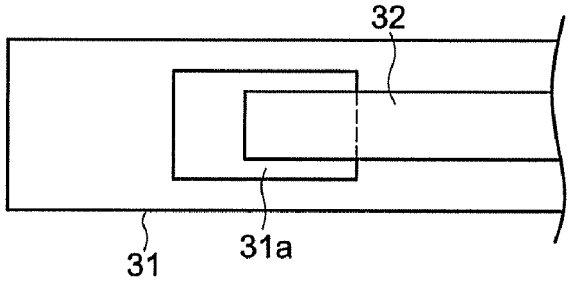

For example, as is shown in FIG. 9 and FIG. 10, in the region in which the first connection electrode 161B and the metal film layer 32 of the connection wirings 3 overlap each other and in the region in which the second connection electrode 162B and the metal film layer 32 of the connection wirings 3 overlap each other, it is also possible to remove at least a part of the insulating layer 31 of the connection wirings 3 thereby forming a removed part 31*a* in which that insulating layer 31 has been removed.

FIG. 9(*a*) is a cross-sectional view of the connection wirings 3 in an example in which a removed part 31*a* by removing a part of the insulating layer 31 so as to cut it, and FIG. 9(*b*) shows the plan view of that part, while FIG. 10(*a*) is a cross-sectional view of an connection wiring 3 in an example in which a removed part 31*a* is formed by removing a part of the insulating layer 31 so as to form an opening of a rectangular shape, and FIG. 10(*b*) is the plan view of that part. By forming a removed part 31 in the connection wirings 3 in this manner, the metal film layer 32 on the top surface of the insulating layer 31 goes towards the bottom surface of the insulating layer 31 at the removed part 31*a*.

The removed part 31*a* can be formed, after the pattern formation is done of the metal film layer 32, by carrying out selective etching from the side of the insulating layer 31.

Figure 11:
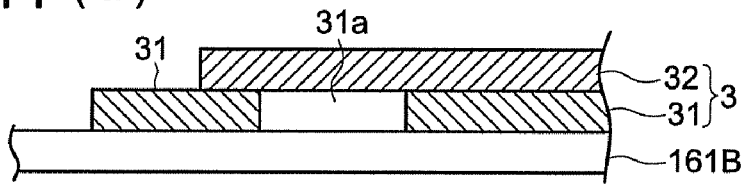
FIG. 11(*a*) to FIG. 11(*c*) are cross-sectional views showing some other forms of conduction of the connections.
Figure 11:
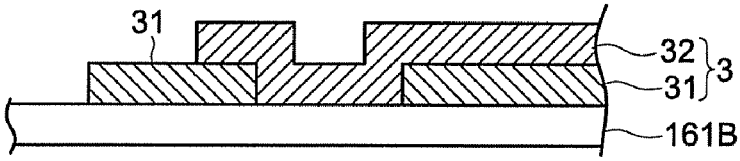
Figure 11:
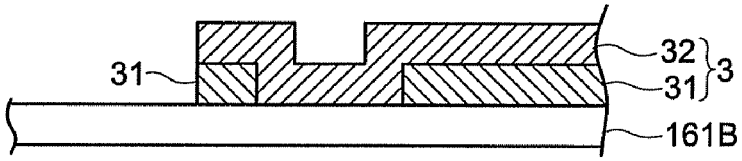

A method of obtaining conduction with the first connection electrodes 161B by a connection wiring 3 having a removed part 31*a* in this manner is shown in FIG. 11.

To begin with, after the removed part 31*a* positioned and placed over the first connection electrode 161B (FIG. 11(*a*)), the top part of the removed part 31*a* is heated and pressed, thereby making the metal film layer 32 contact with the first connection electrode 161B via the removed part 31*a* (FIG. 11(*b*)). After that, the unnecessary insulating layer 31 is removed by dry etching (FIG. 11(*c*)). Even the conduction with the second connection electrode 162B can be made in a similar manner.

As the adhesive material for bonding the insulating layer 31 to the rear surface of the head chip 1, an epoxy type adhesive is suitable from the point of view of resistance to ink, adhesive force, etc. The electrical connection between the metal film 32 in the removed part 31*a* and the first connection electrode 161B is made by the NCP (Non Conductive Paste) method of obtaining electrical connection by pressure bonding the metal films using an adhesive material. In this case, an epoxy type adhesive material not only functions as an adhesive material for the insulating layer 31, but also functions as an NCP. In the case of the NCP method, since it is difficult to obtain connection if the surface of the metal film layer is oxidized, it is desirable that the surface of the first connection electrode 161B, the second connection electrode 162B, and of the metal film layer 32 is a metal such as Au, Pt, etc., and this can be realized by making the metal film have multiple layers.

Further, it is also possible to use the ACP method (Anisotropic Conductive Paste method) of using an adhesive material in which metal particles have been dispersed. In this case, since the metal particles make the connection by penetrating the oxide film on the surface of the metal film layer 32, even in the case of surfaces of a metal such as Al that tend to become oxidized easily, it is possible to obtain a definite electrical connection.

A certain amount of film thickness and strength in the metal film layer 32 will be necessary in the method of forming the removed part 31*a* since the condition in which only the metal film layer 32 remains in the removed part 31*a* will occur where the removed part 31*a* is formed in the insulating layer 31. As the metal film layer 32 in this case, it is desirable to form a Cu film with a film thickness of about 20 μm rather than Al. In order to further improve the reliability of connection, it is desirable that a Ni/Au plating is made.

Figure 12:
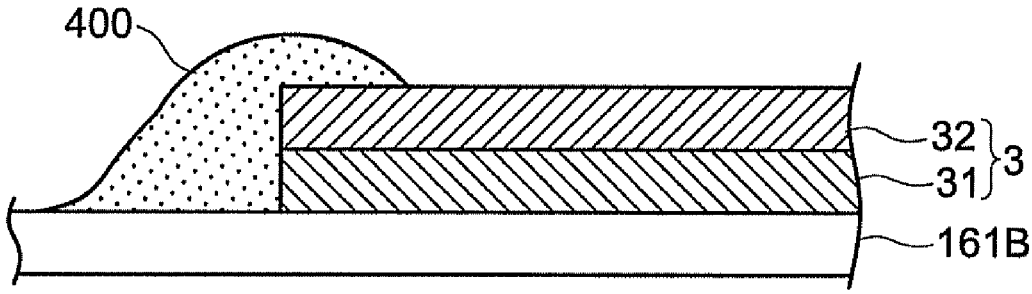
FIG. 12 is a cross-sectional view showing another conduction form of the connection.

Further, as another method, as is shown in FIG. 12, it is also possible to adhere the connection wiring 3 to the rear surface of the head chip 1, and after removing the unnecessary insulating layer 31 by dry etching, obtaining conduction between the metal film layer 32 and the first connection electrode 161B by coating a conductive adhesive material 400 over them at the edge part of the connection wirings 3. As the conductive adhesive material 400, it is desirable to have resistance to solvents and have an epoxy type adhesive as its component. Further, instead of a conductive adhesive material, it is also possible to obtain conduction by coating a low melting point solder in a similar manner. The conduction with the second connection electrode also can be obtained in a similar manner.

Figure 13:
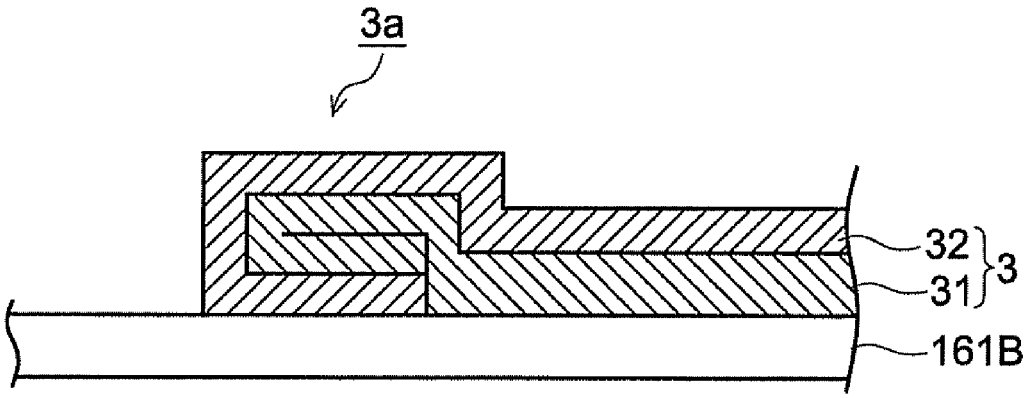
FIG. 13 is a cross-sectional view showing another conduction form of the connection.

In addition, as another method, as is shown in FIG. 13, it is also possible to form the end part of the connection wirings 3 into a bent part 3*a* by bending towards the inside the insulating layer 31 so that the metal film layer 32 on its surface is exposed. It is possible to obtain conduction between the metal film layer 32 and the first connection electrode 161B, by positioning and connecting the bent part 3*a* above the first connection electrode 161B, similar to the case in FIG. 11. In this case, it is necessary to form separately the flow path restricting member 4 for the different air channels 13 of row B since it is necessary to form the bent part 3*a* by bending the end part of an insulating film on which a metal film has been patterned almost equal to the length from the first connection electrode 161B to the second connection electrode 162B. The conduction with the second connection electrode also can be obtained in a similar manner.

The concrete means for carrying out electrical connection between each of the connection electrodes 16A and each of the second connection electrodes 162B on the rear surface of such an head chip 1, and the driving circuits (not shown in the figure) are not particularly restricted, and it is possible to use various types of means. For example, by bonding a wiring substrate 5 as is shown in FIG. 14, it is possible to carry out electrical connection between each of the connection electrodes 16A and each of the second connection electrodes 162B formed by leading out on the rear surface of such an head chip 1, and the driving circuits (not shown in the figure).

Figure 14:
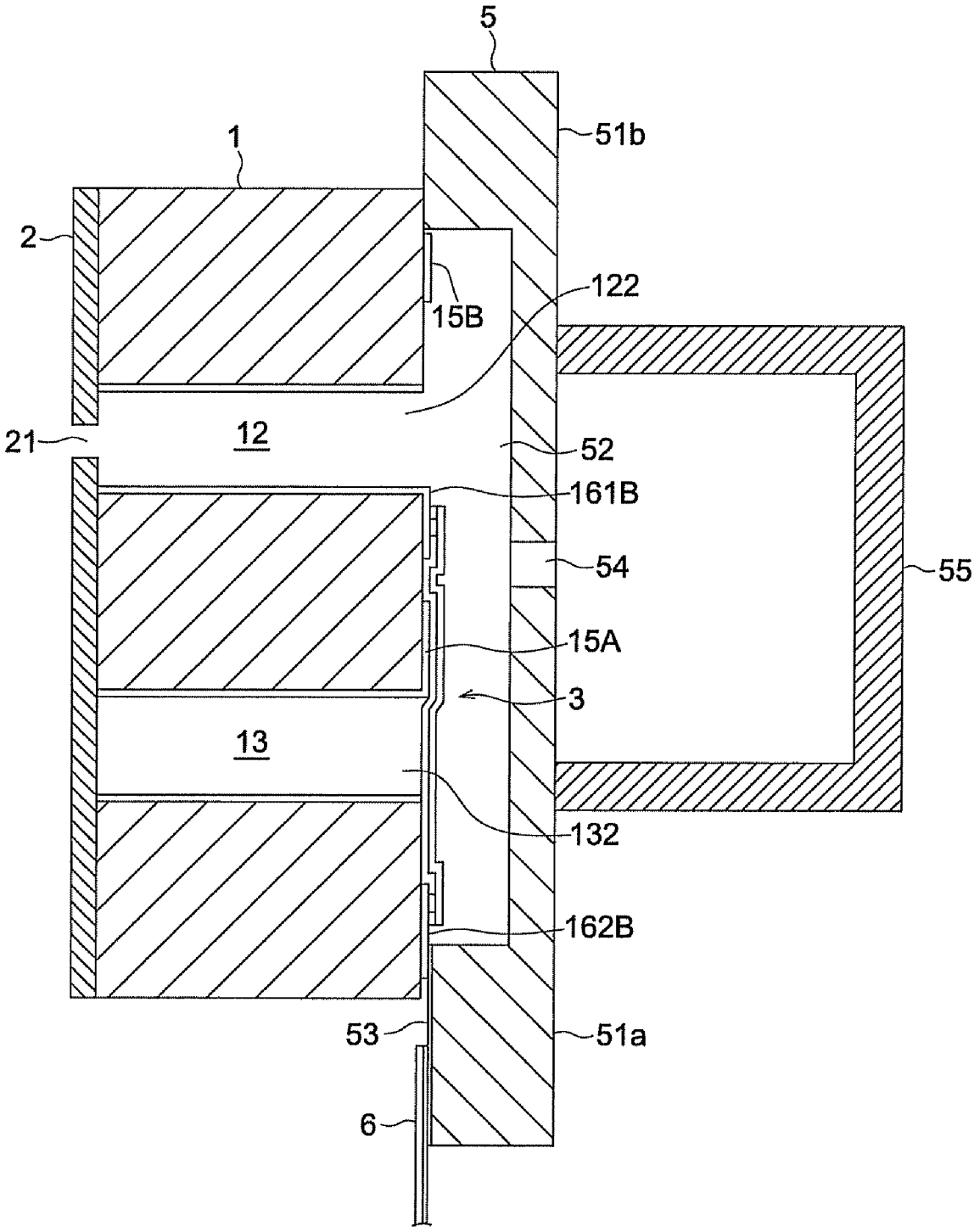
FIG. 14 is a cross-sectional view showing an example of an ink jet head provided with a wiring substrate.

FIG. 14 is a cross-sectional view of a head chip 1 to which a wiring substrate 5 has been bonded and shows the cross-section similar to that at the lines (ii)-(ii) of FIG. 1.

The wiring substrate 5 is formed from a plate shaped substrate made of a ceramic material such as non-polarizing PZT or AlN—BN, AlN, etc. Further, it is also possible to use a low thermal expansion plastic or glass, etc. In addition, it is desirable to use the same substrate material as the piezoelectric device substrate used in the head chip 1 after depolarizing. Further, in order to suppress the deformation, etc., of the head chip 1 due to differences in the thermal expansion coefficient, it is still more desirable to select a material whose thermal expansion coefficient is different from that of the head chip 1 by within ±1 ppm. The material constituting the wiring substrate 5 is not limited to a single sheet of material, but it is also possible to superimpose a plurality of thin plate shaped materials so that the desired thickness is obtained.

The wiring substrate 5 extends in a direction perpendicular to channel row direction of the head chip 1 (the up-down direction in FIG. 14), and has the projecting parts 51*a* and 51*b* that largely extend respectively beyond the top surface and the bottom surface of the head chip 1. In addition, one single depressed part 52 extending along the width direction (the direction of the channel rows) has been formed on one surface of the wiring substrate 5 that is bonded to the rear surface of the head chip 1. This depressed part 52 has been formed to have a size so that it can cover the opening parts 122 and 132 on the rear surface side of all the channels 12 and 13 along the direction of the channel rows of both row A and row B, and forms the common ink chamber that commonly supplies ink to each of the ink channels 12 of row A and row B (the ink channels 12 of row A are not shown in FIG. 14).

In other words, the height of the depressed part 52 in the up-down direction in the figure is larger than the height across the area from row A to row B of the rear surface of the head chip 1, but is smaller than the thickness of the head chip 1 in a direction perpendicular to the direction of the channel rows. Because of this, when the wiring substrate is bonded to the rear surface of the head chip 1, the each channel row of row A and row B is fully included within the depressed part 52.

Each connection wiring 3 and each flow path restricting members 4 (not shown in FIG. 14) on the rear surface of the head chip 1 are enclosed within this depressed part 52. In other words, the wiring substrate 5 is bonded to the rear surface of the head chip 1 at the very narrow region at the top and bottom edge parts in which the connection wirings 3 and the flow path restricting members 4 have not been formed. This region is extremely close to the different channels 12 and 13 of row A and row B (for example, as close as 0 to 200 μm), and extremely difficult position adjustment operation with an extremely high accuracy is needed when the flow path restricting member 4 is formed by joining one sheet of a plate shaped member as in the conventional method. However, according to the present preferred embodiment, since the connection wirings 3 and the flow path restricting members 4 are being formed using patterning technology, high positioning accuracy can be achieved, and also, it is easy to form in extremely close proximity to the different channels 12 and 13, and it is possible to acquire easily the regions for the electrical connection of the different connection electrodes 16A (not shown in FIG. 14) or the second connection electrodes 162B and the common electrodes 15A and 15B. Of course, even if the adhesive material seeps to this region, there is no problem in the electrical connections since it is dissociated and removed during dry etching.

At the one extending part 51*a* of the wiring substrate 5, are formed connection electrodes 53 having the same number and same pitch as the connection electrodes 16A and the second connection electrodes 162B that are aligned at the bottom edge part of the rear surface of the head chip 1. The wiring substrate 5 is bonded to the rear surface of the head chip 1 by an anisotropic conductive paste, etc., so that one ends of the connection electrodes 53 are respectively connected electrically to the connection electrodes 16A and the second connection electrodes 162B. The driving circuits can connect respectively with the driving electrodes 14 of the ink channels 12 through electrically connecting FPC6, etc., respectively to the other ends of connection electrodes 53 at the extending part 51*a* of the wiring substrate. The electrical connection with each common electrode 15A and 15B can be made, for example, at the side of the wiring substrate 5.

Although the supply of ink to the depression part 52 that becomes the common ink chamber can be made at both ends or at one of the ends of the depression part 52 at the time the wiring substrate 5 is bonded to the rear surface of the head chip 1. It is also possible to form an opening part 54 that penetrates to the surface opposite to the surface that is bonded with the head chip 1 from the bottom part of the depression part 52, and to join further an ink manifold 55 that has a box shape and can store a larger quantity of ink than the depression part 52 as is shown in FIG. 14.

However, in the head chip 1, since the driving electrodes 14 inside the ink channels 12 contact the ink directly, a protective film is necessary on the surfaces of the driving electrodes 14 when using a water based ink. In addition, since even the connection wirings 3 and the flow path restricting members 4 come into direct contact with the ink, when using an ink based on solvents, protective films are needed to protect these from the solvents. In view of this, after forming the connection wirings 3 and the flow path restricting members 4 on the rear surface of the head chip 1, it is desirable to form protective films on the entire surface of the head chip 1, that is, on the surfaces of the different driving electrodes 14 and the surfaces of the connection wirings 3 and flow path restricting members 4.

As the protective films, it is desirable to coat using a film made of paraxylylene and its derivatives (hereinafter referred to parylene film). A parylene film is a plastic film made of polyparaxylylene resin and/or its derivatives, and can be formed by the CVD (Chemical Vapor Deposition) method using solid diparaxylylene dimer or its derivatives as the evaporation source. In other words, the paraxylylene radical generated by the evaporation and thermal dissociation of diparaxylylene dimer is adhered onto the surface of the head chip 1 and carries out polymerization reaction thereby forming the film.

There are various types of parylene films and as the desired parylene film it is possible to use a parylene film having a multilayer structure laminating various types of parylene films according to the required characteristics.

The film thickness of such parylene films should desirably be 1 μm to 10 μm.

Since parylene films penetrate even very small regions and can form films, by forming the films on the head chip 1 before joining the nozzle plate 2, not only the driving electrodes 14 but also the connection wirings 3, the flow path restricting members 4, are covered by the parylene film and are protected from ink at the inner surfaces inside the air channels 13 and the outer surfaces exposed at the rear surface of the head chip 1.

By forming these parylene films, both surfaces of the connection wirings 3 and the flow path restricting members 4 can be protected, and it is possible to largely improve their durability.

Further, even if a pin hole is generated in the parylene film covering the connection wirings 3 and the flow path restricting members 4 and solvent based ink penetrates, since the parylene film itself does not dissolve and remains to exist on both surfaces of the connection wirings 3 and the flow path restricting members 4, the function of closing the air channels is not lost easily, and it is possible to maintain the reliability over a long period.

In addition, as in the present preferred embodiment, by forming the connection wirings 3 and flow path restricting members 4 independently and individually so as to close each air channel 13, since the effect when pin holes, etc., are generated in the parylene film is restricted only to that particular air channel 13 and does not extend to other air channels 13, there is also the advantage that the damage can be restricted to the minimum extent.

When forming parylene films in this manner, the nozzle plate 2 is bonded thereafter.

Further, as in FIG. 14, when the wiring substrate 5 is bonded to the rear surface of the head chip 1, the parylene film described above is formed before the nozzle plate 2 is bonded to the head chip 1, but after bonding the wiring substrate to the head chip 1. Because of this, in addition to achieving electrical connection between the different electrodes, it is possible to protect the adhesion layer between the wiring substrate 5 and the head chip 1.

Figure 15:
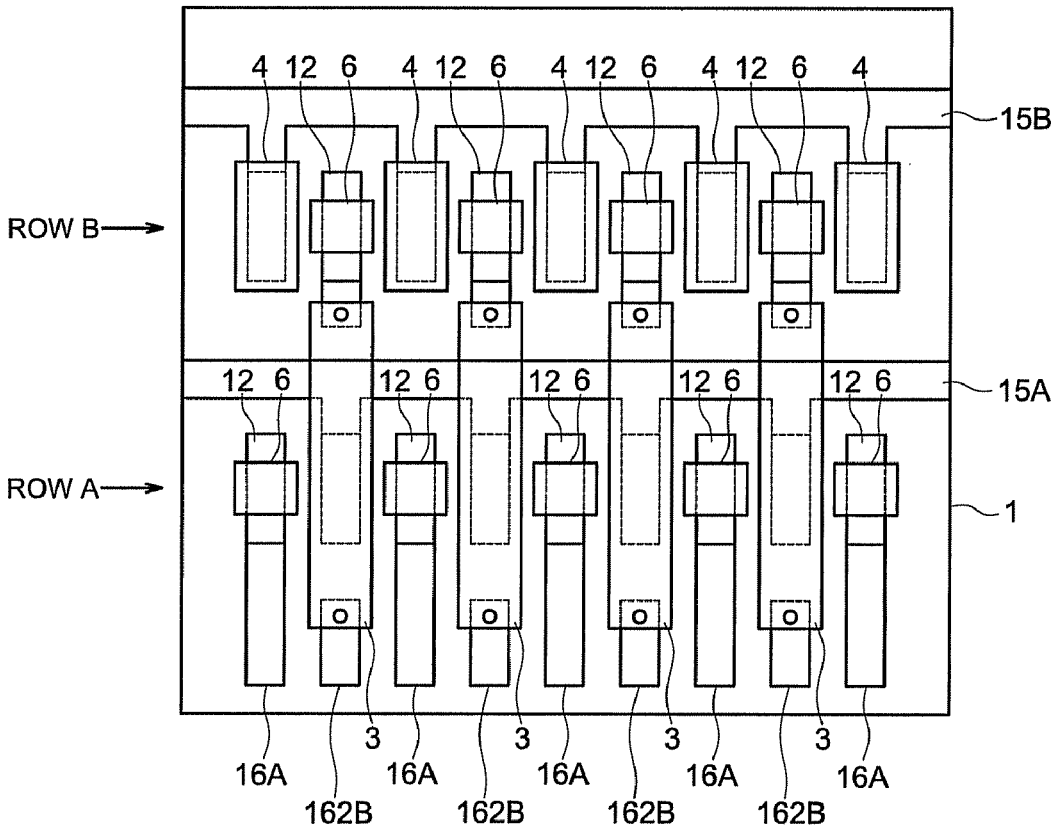
FIG. 15 is a drawing of a head chip part of an ink jet head provided with a flow path restricting member in the ink channel as viewed from the rear surface side.

Although in the form described above no member has been provided for restricting the flow of ink to the opening part 122 of each ink channel 12, it is also possible to form independently and individually a flow path restricting member 7 in the opening part on the rear surface of each ink channel 12 of row A and row B, so as to narrow the opening area of the opening part as is shown in FIG. 15.

This flow path restricting member 7 is slightly wider than the widths of each of the ink channels 12 along the width direction in the direction of the channel rows, and slightly smaller than the heights of each of the ink channels 12 in the up-down direction at right angle to the width direction. Because of this, each flow path restricting member 7 reduces the opening area by closing a part of the opening part on the rear surface of each of the ink channels 12, and the opening parts are in a state in which only their top end and bottom end open.

Because of this, since each ink channel 12 has the opening area of the opening part on the side of the rear surface restricted by the flow path restricting member 7, similar to the conventional case of using a flow path restricting member opening the ink supply inlet, it is possible to suppress effectively the vibration of the ink meniscus of the nozzle when the head is driven at a high speed.

Figure 16:
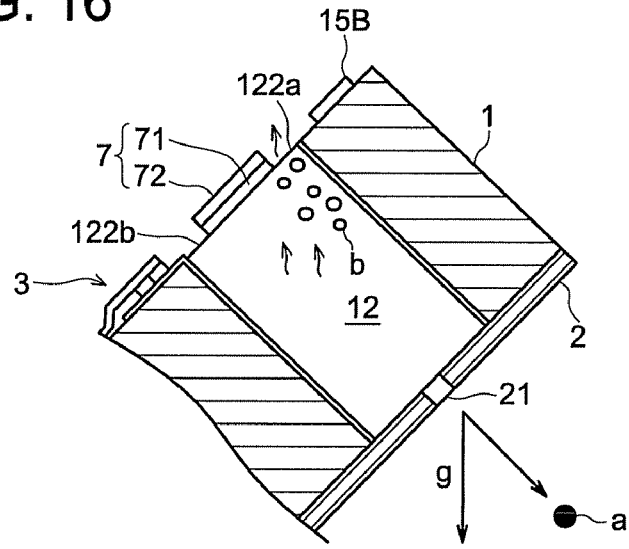
FIG. 16 is a partial cross-sectional drawing showing the condition in which the head chip shown in FIG. 15 is provided in an inclined manner.

In addition, this flow path restricting member 7 is different from the conventional flow path restricting member that forms the ink supply inlet at the central part of the opening part of the ink channel. The top end and the bottom end of the opening part 122 of the ink channel 12 are opened thereby forming the respective opening parts 122*a* and 122*b* as is shown in FIG. 16. The opening part 122*a* that has not been closed by the flow path restricting member 7 is positioned to the top-most part of the ink channel 12 and the air bubbles b generated inside the ink channel 12 collect at this topmost part, and escape easily to the common ink chamber outside the head chip 1 from the opening part 122*a*, when the ink jet head is installed at an inclination so that the direction of ejection of the ink a inclines to the gravitational direction g. Even if air bubbles are present in the common ink chamber, since there is no effect on the ejection, there is no generation of problems due to the air bubbles b.

The head excels in high property of releasing air bubbles and high ejection reliability, through making openings in the top end and bottom end parts of this opening part 122, by the flow path restricting member 7 formed in the manner disclosed above to restrict the opening part 122 on the rear surface side of each of the ink channels.

It is desirable to make the opening area of the opening part 122 on the rear surface side equal to about 1 to 10 times of the area of the opening on the ejection side of the nozzle 21 formed in the nozzle plate 2 after each ink channel 12 is restricted by the flow path restricting member 7, and still more desirably 2 to 5 times. It is desirable to obtain the optimum value from the results of carrying out ejection tests. The optimum opening area of the opening part 122 on the rear surface side after being restricted by the flow path restricting member 7 was of 2000 $\mu m^2$ in the case of a head chip with a nozzle diameter of 28 μm (opening area of 615 $\mu m^2$) according the experiments by the present inventors.

Further, here, the flow path restricting member 7 was formed so that both the top end and bottom end parts of the opening part 122 of the ink channels 12 were open thereby forming the opening parts 122*a* and 122*b*. Because of this, since it is possible to make the air bubbles b escape when either of the top surface and the bottom surface of the head chip 1 is facing up, it is desirable because there is no restriction in the case of installing the ink jet head in an inclined position. However, the present invention shall not be restricted to this, and it is possible to form the flow path restricting member 7 so that only one of the tip end and bottom end of the opening part 122 on the rear end surface of the ink channel 12 is opened. In this case, it is possible to make the air bubbles b escape by installing the ink jet head in an inclined position so that the side of the opening part 122 on the rear surface side that is open and is not being closed by the flow path restricting member 7 comes at the top.

Although the method of forming this flow path restricting member 7 is not particularly restricted, it is desirable to form this in the same manner as the connection wirings 3 and the flow path restricting member 4. In other words, as is shown in FIG. 16, it is desirable that the flow path restricting member 7 is constituted as a multilayer body having a insulating layer 61 and a metal film layer 62, and among these, the insulating layer 61 is adhered so that it is positioned on the rear surface of the head chip 1. It is possible to form the patterns independently and individually with a high accuracy even the flow path restricting member 7 disclosed above, at the same time as the connection wirings 3 and the flow path restricting member 4 by dry etching.

Figure 17:
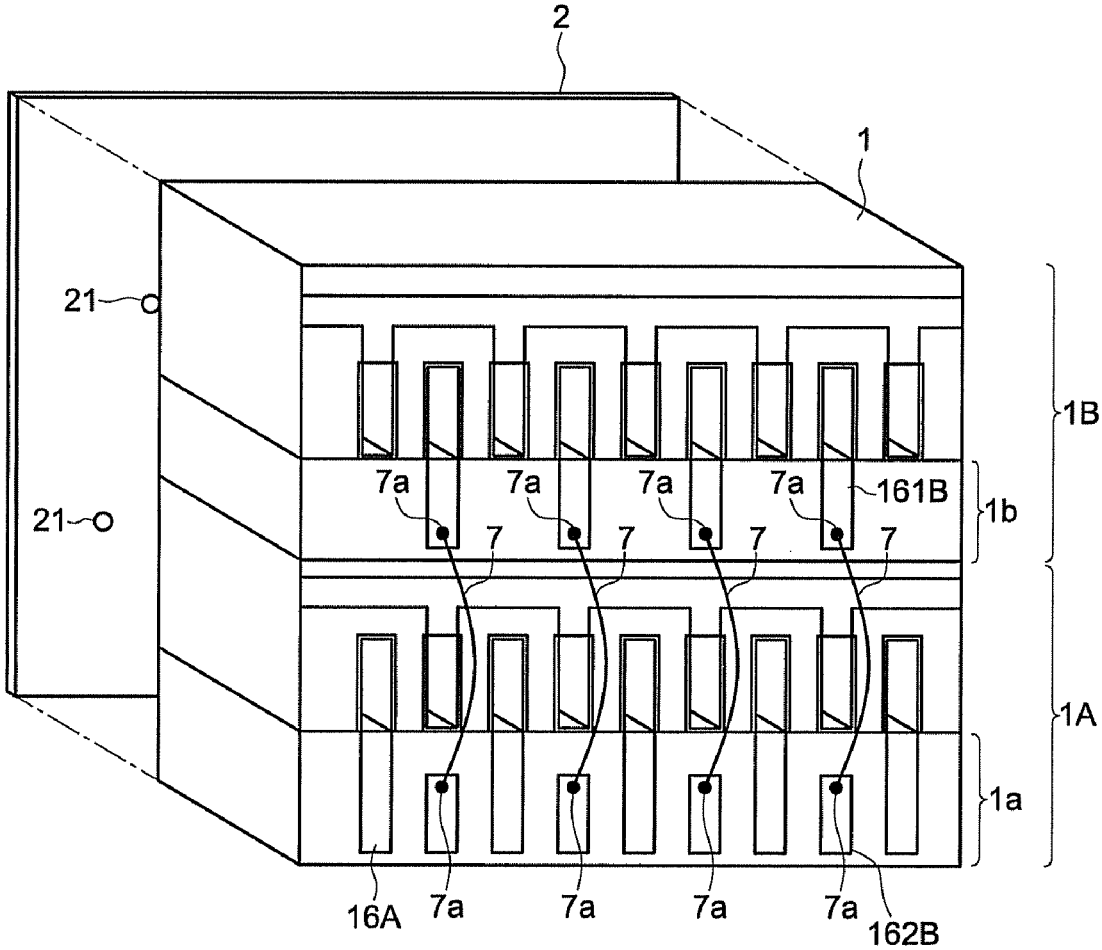
FIG. 17 is a perspective view as seen from the rear surface side of the head chip part of an ink jet head showing another form for electrically connecting the first connection electrode and the second connection electrode.

FIG. 17 shows another form for electrically connecting the first connection electrodes 161B and the second connection electrodes 162B, wherein the first connection electrodes 161B and the second connection electrodes 162B are electrically connected respectively by a wiring 8 formed by the wire bonding method. It is possible to prevent easily electrical short circuits with the common electrodes 15A that are present between them since it is possible to wire between the first connection electrodes 161B and the second connection electrodes 162B with a prescribed loop height by forming such wiring 8 using the wire bonding method.

The wire bonding method can be either ball bonding or wedge bonding.

Further, it is possible to use the usual metal wires that can be wire bonded as the wiring 8, and some examples are Al, Cu, Au, Ni, etc.

When forming the wiring 8 using the wire bonding method in this manner, in the head chip 1, it is desirable that a region corresponding to a bonding sections 8*a* at which each end of the wire is bonded respectively to the first connection electrodes 161B and the second connection electrodes 162B is formed of a non-piezoelectric material. This is because, it may cause damage of the head chip 1 since these bonding sections 8*a* are formed by the impact of capillary or wedge tool at the time of bonding, if this region is a piezoelectric material that is weak to shock.

In the form shown in FIG. 17, the head chip 1 having two rows of channels, row A and row B, is made up of a head chip 1A having the row of channels of row A and a head chip 1B having the row of channels of row B bonded together, and in which, the region 1*a* of the bottom edge part of the head chip 1A in which are aligned the connection electrodes 16A and the second connection electrodes 162B is formed from a non-piezoelectric material, and the region 1*b* of the bottom edge part of the head chip 1B where the first connection electrodes 161B are aligned is made of a non-piezoelectric material.

At the time of manufacturing these head chips 1A and 1B, it is possible to form using a non-piezoelectric material for the substrate 100 shown in FIG. 3.

As the non-piezoelectric material, although generally it is possible to use a plate shaped substrate made of a ceramic material, it is also possible to use a low thermal expansion plastic or glass, etc. In addition, in order to suppress the deformation, etc., of the head chip 1 due to differences in the thermal expansion coefficient, it is still more desirable to select a material whose thermal expansion coefficient is different from that of the piezoelectric material forming the channels 12 and 13 by within ±1 ppm.

Even when the wiring 8 is formed using the wire bonding method in this manner, it is desirable to form a protective film on the surface of these wirings 8 by coating a film based on paraxylylene and its derivatives as described earlier.

Further, even in the form shown in FIG. 17, similar to FIG. 1, it is also possible to provide a flow path restricting member 4 that closes the opening part 132 of the different air channels 13 that face towards the rear surface of the head chip 1, and in addition, similar to FIG. 15, it is also good to provide a flow path restricting member 7 so that the opening area of the opening part 122 of the different ink channels 12. In this case, the wirings 8 can be formed after these flow path restricting members 4 and 7 have been provided.

In the above preferred embodiments, although examples of a head chip 1 having two rows of channels were given, the present invention shall not be restricted to head chips having two rows of channels, but can also be applied to harmonica type independent channel type head chips having a plural number of channel rows of 3 or more rows.

Figure 18:
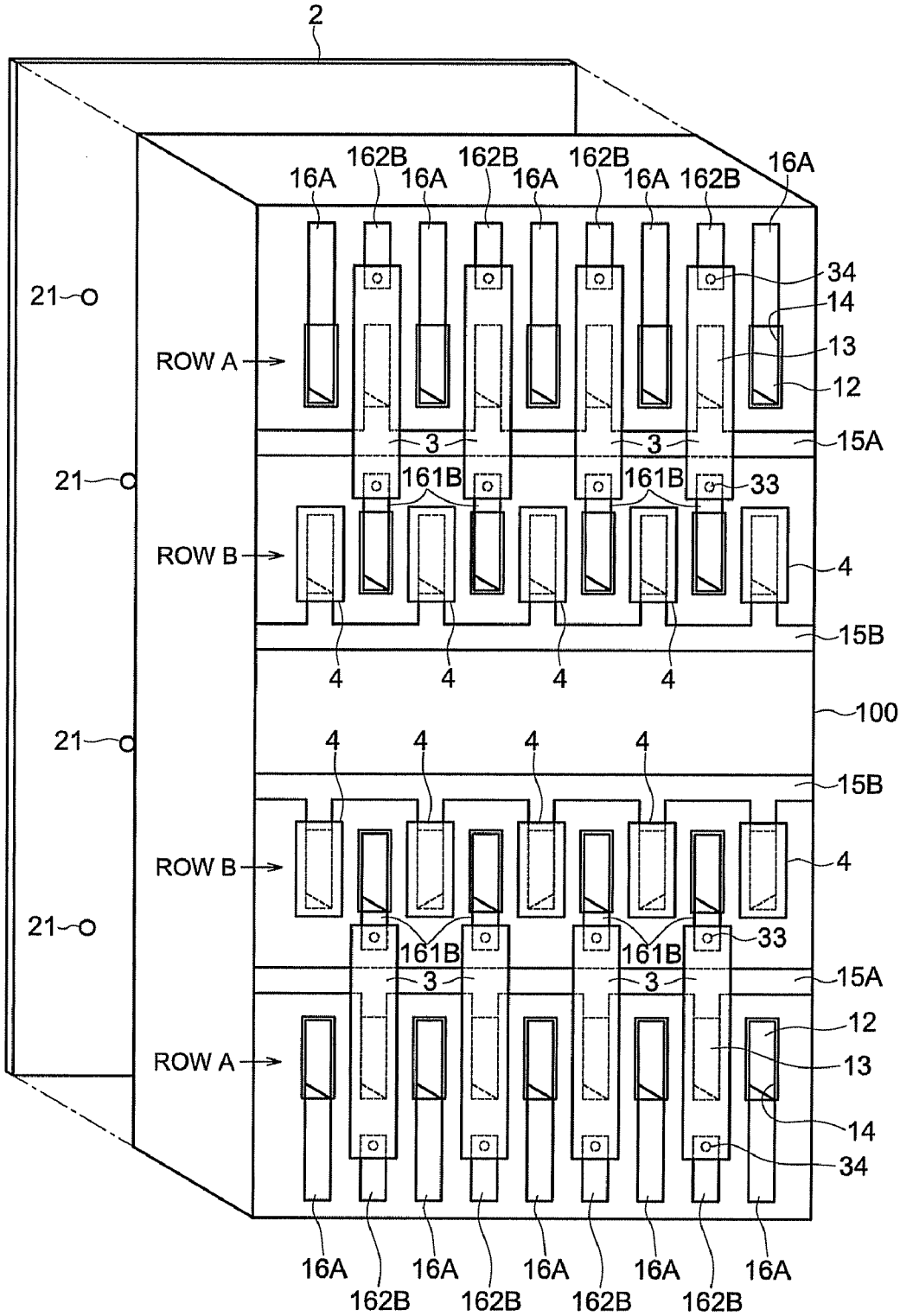
FIG. 18 is a perspective view of the head chip part of the ink jet head which has four rows of channels as viewed from the rear surface side.

For example, FIG. 18 shows a harmonica type independent channel type head chip having four rows of channels 100. The parts indicated by the same symbols as FIG. 1 indicate the parts having the same constitutions and no detail explanations are shown.

The head chip having four rows of channels 100 can be formed by superimposing four pieces of the head substrates 106 indicated in FIG. 3(*e*), for example.

The present invention can be applied to the head chip 100, by regarding adjacent two rows of channels among four channel rows each from the low edge and from the top edge of the head chip 100 as one groups. And therefore, the four channel rows are divided into two groups. One group comprises two adjacent channel rows from the top end of the drawing and the other group comprises two adjacent channel rows from the bottom end of the drawing. Two channel rows of each group are regarded as row A and row B, same as FIG. 1, and it is possible to aligned the connection electrodes 16A and the second connection electrodes 162B each electrically connecting to the drive electrodes 14, at both upper and lower ends parts on the rear surface of the head chip 100. And therefore the drive electrodes 14 of the ink channels 12 can be easily electrically connected to the drive circuit through the connection electrodes 16A and the second connection electrodes 162B at both upper and lower edges parts on the rear surface of the head chip 100.

Figure 19:
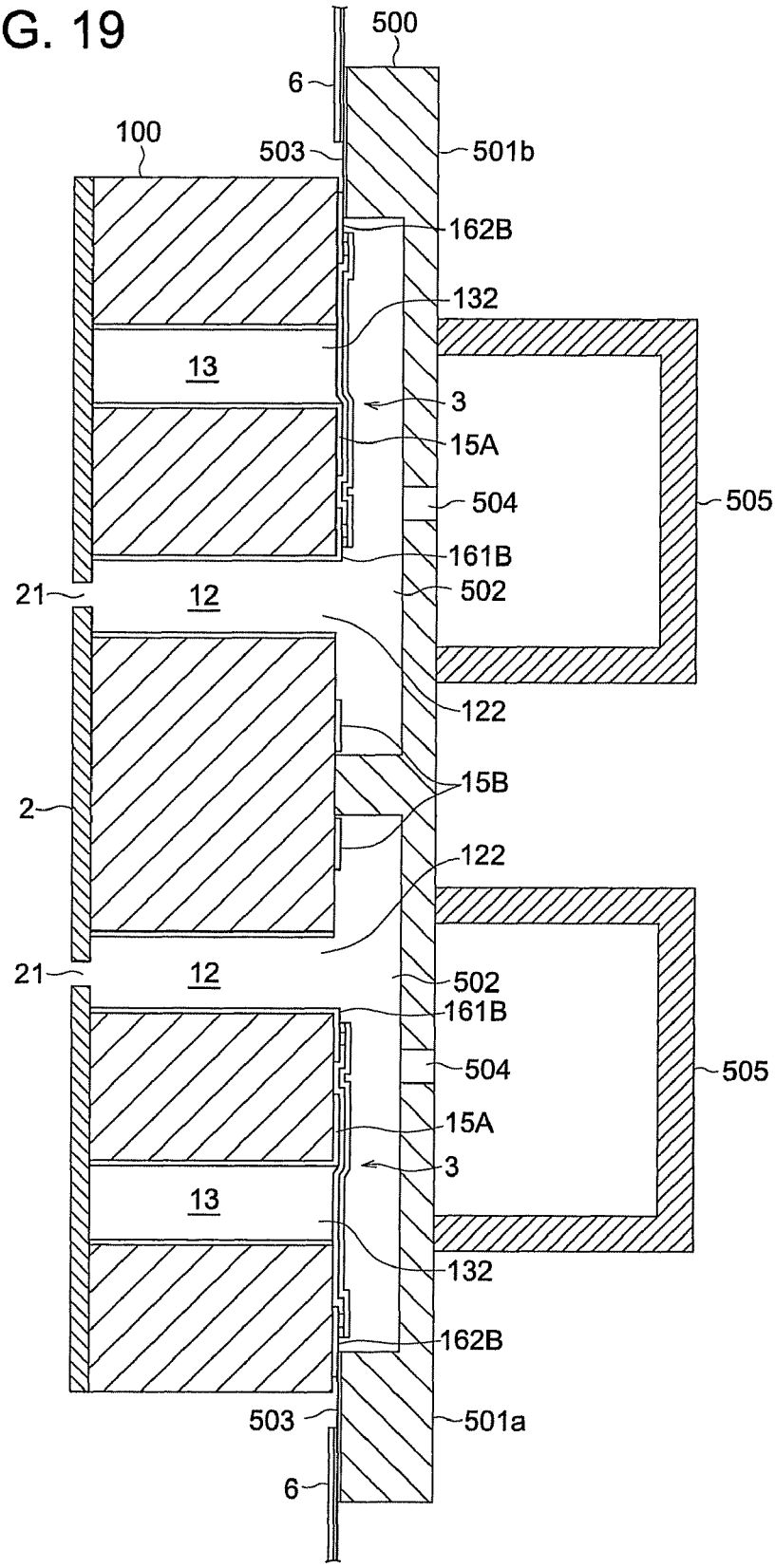
FIG. 19 is a cross-sectional view showing a condition of bonding a wiring substrate to the rear surface side of the head chip part shown in FIG. 18.

FIG. 19 is a cross-sectional view of the head chip 100 shown in FIG. 18 to which a wiring substrate 500 has been bonded at the rear surface.

The wiring substrate 500 has projecting parts 501*a* and 501*b* that largely extend respectively beyond the top surface and the bottom surface of the head chip 100 and connection electrodes 503 are formed at both extended parts 501*a*, 501*b*. One end of the extended part connects electrically to the connection electrodes 16A and to the second connection electrodes 162B lead out each to the upper end or the lower end in the rear surface of the head chip 100. And therefore FPC 6 is joined to the other end of the electrode 503 at each extended part 501*a*, 501*b* and therefore connects electrically a drive circuit with the connection electrodes 16A and the second connection electrodes 162B.

Two depression parts 502 are formed at the wiring substrate 500 so that each depression part 502 includes two rows of channels of head chip 100. An opening part 504 is formed at each depression part 502 and ink is supplied to an independent manifold 505 through each opening part 504. Therefore one head 100 can eject two different inks when different inks are separately supplied into the two ink manifolds 505.

But one depression part 502 with the size of covering all four rows of channels of the head chip 100 can be formed at the wiring substrate 500, or But one ink manifold 505 having of a depression part 502 with the size of covering all four rows of channels of the head chip 100 can be formed at the wiring substrate 500 or, two depression parts 502 and one ink manifold 505 covering two opening parts 504 through which each depression part 502 communicates with the manifold 505 can be formed at the rear side of the wiring substrate 500, when the head chip 100 is required to eject only one color of ink.

Flow path restricting members 7 can be provided at the head chip 100 just as shown in FIG. 15 and the wirings 8 formed by the wire bonding method can be adopted just as disclosed in FIG. 17.

According to the present invention, it is possible to provide an inkjet head in which it is possible to aim at simplifying connections to an FPC, etc. by aligning the different connection electrodes formed by leading out from each ink channel to the edge part of the rear surface of an independent channel type harmonica type head chip in which a plurality of rows of channels have been provided. Especially for head chips having four rows of channels, it is possible to provide an inkjet head of high resolution as well as high speed, in which it is possible to aim at simplifying connections to an FPC, etc. according to the present invention.

In addition, even for head chips having more number of channel rows exceeding 4 rows, by applying the present invention to two rows each from the end, it is possible to align the connection electrodes at the end parts of the head chip, and it is possible to aim at simplifying the electrical connection using FPC, etc., for head chips having a plurality or rows of channels.

What is claimed is:

1. An ink jet head having a head chip, the head chip comprising:

a plurality of driving walls made up of a piezoelectric device arranged in parallel with a predetermined distance;

a plurality of ink channels that eject ink, sandwiched by the driving walls, having opening parts of the channels on a front surface and on a rear surface of the head chip;

a plurality of air channels that do not eject ink, sandwiched by the driving walls, having opening parts of the channels on a front surface and on a rear surface of the head chip;

a plurality of driving electrodes formed inside of the plurality of ink channels and the plurality of air channels, that causes shear deformation of the driving walls by applying a voltage;

at least one common electrode that conducts with the driving electrodes of the air channels; and a plurality of connection electrodes formed at the rear surface of the head chip that conduct with the driving electrodes of the ink channels separately, wherein the ink channels and the air channels are alternatingly arranged in parallel and form a plurality of channel rows arranged in parallel; and the ink head further having a nozzle plate joined to a front surface of the head chip that closes the opening parts of the air channels on the front surface and has a plurality of nozzles at the opening parts of the ink channels on the front surface, wherein individual connection electrodes of any adjacent two channel rows formed at a side of an edge of the rear surface of the head chip among the plurality of channel rows are parallely aligned at the edge of the rear surface of the head chip.

2. The ink jet head of claim 1,wherein when a channel row placed at the side of the edge of the rear surface of the head chip among the two channel rows formed at the side of the edge of the rear surface of the head chip is taken as row A and a row that is adjacent to the row A is taken as row B, a common electrode that conducts with the driving electrodes of the air channels of the row A is formed by leading out towards the side of the row B, a common electrode conducting with the driving electrodes of the air channels of the row B is formed by leading out either towards a side of the row A or towards a side opposite to the row A;

the connection electrodes that connect with the driving electrodes of the ink channels of the row A are formed by leading out towards the edge of the head chip; and connection electrodes that connect with the driving electrodes of the ink channels of the row B are formed by leading out towards the side of the row A and are wired passing over the common electrode of the row A and the row A so as to be aligned with the connection electrodes of the row A.

3. The ink jet head of claim 2, wherein the head chip comprises four rows of channels and two rows of channels locate at edge sides of the head chip are taken as rows A and two rows of channels medially located are taken as rows B.

4. The ink jet head of claim 2, wherein the connection electrodes of the row B are divided into first connection electrodes that are lead out from different ink channels of the row B and second connection electrodes that are arranged to be aligned with different electrodes of the row A;

multilayer structures having an insulating layer and a metal film layer are formed to completely close at least opening parts of different air channels of the row A among opening parts of all air channels on the rear surface side of the head chip through positioning and adhering the insulating layers on the rear surface side of the head chip and are formed with a length from the first connection electrodes to the second connection electrodes ; and thereby the first connection electrodes are individually wired electrically with the second connection electrodes by the metal film layers of the multilayer structures.

5. The ink jet head of claim 4, wherein the multilayer structures have penetrating electrodes that penetrate through the insulating layers respectively in the regions in which the metal film layers of the multilayer structures overlap the first connection electrodes and in the regions in which the metal film layer of the multilayer structures overlap the second connection electrodes;

the metal film layers of the multilayer structures electrically conduct respectively with the first connection electrodes and with the second connection electrodes through the penetrating electrodes; and the first connection electrodes electrically conduct with the second connection electrodes.

6. The ink jet head of claim 4, wherein at least parts of the insulating layers of the multilayer structures have been removed in the regions in which the metal film layer of the multilayer structures overlap the first connection electrodes and in the region in which the metal film layer of the multilayer structures overlap the second connection electrodes;

the metal film layers of the multilayer structures electrically conduct respectively with the first connection electrodes and the second connection electrodes through the parts in which insulating layers have been removed; and the first connection electrodes electrically conduct with the second connection electrodes.

7. The ink jet head of claim 4, wherein the metal film layer of the multilayer structures electrically conducts respectively with the first connection electrodes and the second connection electrodes through coating a conductive adhesive material or soldering respectively in the regions in which the metal film layers of the multilayer structures overlap the first connection electrodes and in the regions in which the metal film layers of the multilayer structures overlap the second connection electrodes; and the first connection electrodes electrically conduct with the second connection electro des.

8. The ink jet head of claim 4, wherein the metal film layers of the multilayer structures electrically conduct respectively with the first connection electrodes and the second connection electrodes through forming end parts of the multilayer structures into bent parts facing the rear surface of the head chip, respectively in the regions in which the metal film layers of the multilayer structures overlap the first connection electrodes and in the regions in which the metal film layer of the multilayer structures overlap the second connection electrodes; and the first connection electrodes electrically conduct with the second connection electrodes.

9. The ink jet head of claim 4, wherein an insulating layer of the multilayer is formed of organic film that can be dry-etched.

10. The ink jet head of claim 4, wherein the multilayer structures are formed independently at different air channels of the row A.

11. The ink jet head of claim 4 wherein both sides of the multilayer structures are coated using a film made of paraxylylene and its derivatives.

12. The ink jet head of claim 4, wherein the connection electrodes of the row B are divided into first connection electrodes that are lead out from different ink channels of the row B and second connection electrodes that are arranged to be aligned with different electrodes of the row A; and the first connection electrodes and the second connection electrodes are electrically connected respectively by wirings formed by a wire bonding method.

13. The ink jet head of claim 12, wherein a region of the head chip corresponding to a bonding section at which the wires are bonded is formed of a non-piezoelectric material.

14. The ink jet head of claim 12, wherein the wirings formed by a wire bonding method are coated using a film made of paraxylylene and its derivatives.

15. The ink jet head of claim 2, wherein flow path restricting members are formed independently and individually in the opening parts on the rear surface of the different ink channels of the head chip so as to restrict flow paths by narrowing opening areas of the opening parts.

16. The ink jet head of claim 15, wherein flow path restricting members are formed so as to narrowing the opening area of the opening part with making open at least top end parts or bottom end parts of the opening parts of different ink channels.

17. An ink jet head having a head chip, the head chip comprising:

a plurality of driving walls made up of a piezoelectric device arranged in parallel with a predetermined distance;

a plurality of ink channels that eject ink, sandwiched by the driving walls, having opening parts of the channels on a front surface and on a rear surface of the head chip;

a plurality of air channels that do not eject ink, sandwiched by the driving walls, having opening parts of the channels on a front surface and on a rear surface of the head chip;

a plurality of driving electrodes formed inside of the plurality of ink channels and the plurality of air channels, that causes shear deformation of the driving walls by applying a voltage;

at least one common electrode that conducts with the driving electrodes of the air channels; and a plurality of connection electrodes formed at the rear surface of the head chip that conduct with the driving electrodes of the ink channels separately, wherein the ink channels and the air channels are alternatingly arranged in parallel and form a plurality of channel rows arranged in parallel; and the ink head further having a nozzle plate joined to a front surface of the head chip that closes the opening parts of the air channels on the front surface and has a plurality of nozzles at the opening parts of the ink channels on the front surface, wherein individual connection electrodes of any adjacent two channel rows formed at a side of an edge of the rear surface of the head chip among the plurality of channel rows are parallely aligned at the edge of the rear surface of the head chip;

wherein when a channel row placed at the side of the edge of the rear surface of the head chip among the two channel rows formed at the side of the edge of the rear surface of the head chip is taken as row A and a row that is adjacent to the row A is taken as row B, a common electrode that conducts with the driving electrodes of the air channels of the row A is formed by leading out towards the side of the row B, a common electrode conducting with the driving electrodes of the air channels of the row B is formed by leading out either towards a side of the row A or towards a side opposite to the row A;

the connection electrodes that connect with the driving electrodes of the ink channels of the row A are formed by leading out towards the edge of the head chip; and connection electrodes that connect with the driving electrodes of the ink channels of the row B are formed by leading out towards the side of the row A and are wired passing over the common electrode of the row A and the row A so as to be aligned with the connection electrodes of the row A;

wherein the connection electrodes of the row B are divided into first connection electrodes that are lead out from different ink channels of the row B and second connection electrodes that are arranged to be aligned with different electrodes of the row A;

multilayer structures having an insulating layer and a metal film layer are formed to completely close at least opening parts of different air channels of the row A among opening parts of all air channels on the rear surface side of the head chip through positioning and adhering the insulating layers on the rear surface side of the head chip and are formed with a length from the first connection electrodes to the second connection electrodes; and thereby the first connection electrodes are individually wired electrically with the second connection electrodes by the metal film layers of the multilayer structures.

18. The ink jet head of claim 17, wherein the head chip comprises four rows of channels and two rows of channels locate at edge sides of the head chip are taken as rows A and two rows of channels medially located are taken as rows B.

19. The ink jet head of claim 17, wherein the multilayer structures have penetrating electrodes that penetrate through the insulating layers respectively in the regions in which the metal film layers of the multilayer structures overlap the first connection electrodes and in the regions in which the metal film layer of the multilayer structures overlap the second connection electrodes;

the metal film layers of the multilayer structures electrically conduct respectively with the first connection electrodes and with the second connection electrodes through the penetrating electrodes; and the first connection electrodes electrically conduct with the second connection electrodes.

20. The ink jet head of claim 17, wherein an insulating layer of the multilayer is formed of organic film that can be dry-etched.

21. The ink jet head of claim 17, wherein the multilayer structures are formed independently at different air channels of the row A.

22. The ink jet head of claim 17 wherein both sides of the multilayer structures are coated using a film made of paraxylylene and its derivatives.

23. The ink jet head of claim 17, wherein flow path restricting members are formed independently and individually in the opening parts on the rear surface of the different ink channels of the head chip so as to restrict flow paths by narrowing opening areas of the opening parts.

24. The ink jet head of claim 23, wherein flow path restricting members are formed so as to narrowing the opening area of the opening part with making open at least top end parts or bottom end parts of the opening parts of different ink channels.

* * * * *